US007407255B2

(12) United States Patent
Iwao et al.

(10) Patent No.: US 7,407,255 B2
(45) Date of Patent: Aug. 5, 2008

(54) METHOD OF TESTING A DROPLET DISCHARGE DEVICE

(75) Inventors: Naoto Iwao, Nagoya (JP); Shin Ishikura, Kokubu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 206 days.

(21) Appl. No.: 11/277,194

(22) Filed: Mar. 22, 2006

(65) Prior Publication Data

US 2006/0214976 A1 Sep. 28, 2006

(30) Foreign Application Priority Data

Mar. 23, 2005 (JP) ..... 2005-083758

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 6,783,201 B2 * 8/2004 Ninomiya ..... 347/8

2005/0083364 A1 * 4/2005 Billow ..... 347/19

FOREIGN PATENT DOCUMENTS

JP 2000062158 A 2/2000

* cited by examiner

*Primary Examiner*—Lamson D. Nguyen
*Assistant Examiner*—Justin Seo
(74) *Attorney, Agent, or Firm*—Baker Botts L.L.P.

(57) ABSTRACT

A test sheet is set in a droplet discharge device at a first distance. At least one droplet is discharged toward the test sheet from a nozzle formed in the droplet discharge device to form at least one first dot on the test sheet. The test sheet is set in the droplet discharge device at a second distance differing from the first distance. At least one droplet is discharged toward the test sheet from the nozzle to form at least one second dot on the test sheet. A nozzle position error or a nozzle discharge angle error are calculated from the position of the first dot, the position of the second dot, the first distance, and the second distance. Testing inkjet heads in this manner allows accurate testing for errors in nozzle position or discharge angle.

20 Claims, 24 Drawing Sheets

( a )

( b )

METHOD OF TESTING A DROPLET DISCHARGE DEVICE

CROSS-REFERENCE TO RELATED APPLICATION

This application claims priority to Japanese Patent Application No. 2005-083758 filed on Mar. 23, 2005, the contents of which are hereby incorporated by reference into the present application.

BACKGROUND OF THE INVENTION

1. Field of the Invention

The invention relates to a method of testing a droplet discharge device.

2. Description of the Related Art

Inkjet heads and other droplet discharge devices are widely known. Droplet discharge devices discharge droplets from a nozzle and cause a liquid to accurately adhere to a target position. So that the liquid accurately adheres to the target position, the nozzle must be formed in a position as designed, and the droplet discharge device must be manufactured so that the droplet is discharged from the nozzle in the direction of the design. Therefore, the position of the nozzle of the droplet discharge device, the discharge angle of the droplets discharged from the nozzle, and other aspects are tested after the droplet discharge device is manufactured.

Testing methods such as that shown in FIG. 24 are used in conventional testing of droplet discharge devices. In this testing method, a transparent test sheet 300 is provided at a position of distance d from a droplet discharge device 301, and a CCD camera 302 is provided on the rear side of the test sheet 300. Droplets are discharged from a nozzle 303 formed in the droplet discharge device 301, and a liquid 304 adheres to the test sheet 300. Once the liquid 304 has adhered to the test sheet 300, the nozzle 303 and the adhered liquid 304 are photographed by the CCD camera 302. The photographed image is processed to detect the position of the nozzle 303 and the position where the liquid 304 adheres. Next, the horizontal deviation L of the position where the liquid 304 adhered and the position of the nozzle 303 is calculated. Once the deviation L is calculated, the discharge angle θ is calculated from distance d and deviation L. The data of the calculated nozzle position and discharge angle are fed back into the manufacturing process to enable the manufacture of droplet discharge devices of a high precision.

BRIEF SUMMARY OF THE INVENTION

The position and discharge angle of the nozzle of a droplet discharge device can be tested with this testing method. In this method, however, the nozzle and liquid adhering to the test sheet are photographed from the rear side of the test sheet with a CCD camera. A transparent test sheet must therefore be used. The recording surface of transparent test sheets is rough, so the liquid readily adheres with a distorted shape. If the liquid does not optimally adhere to the test sheet, the position of liquid adherence cannot be accurately detected. Moreover, if the transparent test sheet is not provided flatly, the CCD camera cannot accurately photograph the nozzle, so the position of the nozzle cannot be accurately detected.

As described above, the position of the nozzle or the discharge angle sometimes cannot be accurately tested with conventional testing methods because a transparent test sheet is used. In addition such testing methods are also unable to test how much the nozzle position deviates from the designed position.

The invention provides a method for accurately testing the nozzle position or discharge angle of a droplet discharge device.

A method of testing a droplet discharge device of the present teaching comprises the following steps:

a first step of setting a test sheet at a first distance from the droplet discharge device;

a second step of discharging at least one droplet toward the test sheet set in the first step from a nozzle formed in the droplet discharge device to form at least one first dot on the test sheet;

a third step of setting a test sheet at a second distance from the droplet discharge device, the second distance being different from the first distance;

a fourth step of discharging at least one droplet toward the test sheet set in the third step from the nozzle to form at least one second dot on the test sheet; and a fifth step of calculating either position error of the nozzle or discharge angle error of the nozzle from the position of the first dot, the position of the second dot, the first distance and the second distance.

The same test sheet may be used in the first and third steps, or different sheets may be used in the first and third steps.

In the second step of this testing method, a droplet is discharged to a test sheet from a droplet discharge device provided at a first distance to print a first dot. In the fourth step, a droplet is discharged to a test sheet provided at a second distance differing from the first distance to print a second dot. The first dot and second dot, printed at different distances, are compared to determine the position and discharge angle of the nozzle that printed the dots. Abnormalities therein can be detected from the nozzle position or discharge angle thus determined.

With this testing method, the nozzle and liquid adhering to the test sheet need not be photographed from the rear side of the test sheet with a CCD camera. The test sheet therefore need not be transparent. The test sheet to be used can be freely selected. The use of a test sheet with a liquid-absorbing layer formed on the recording surface or a test sheet with a smooth recording surface allows the position of the nozzle or discharge angle to be more accurately determined.

When droplets are discharged from a plurality of nozzles of a droplet discharge device, the discharge velocity variance of the plurality of nozzles can be determined by discharging the droplets toward a sheet that moves within the plane of the sheet.

A method of testing a droplet discharge device of this teaching comprises the following steps:

a first step of setting a test sheet at a first distance from the droplet discharge device;

a second step of discharging at least one droplet toward the test sheet set in the first step from the plurality of nozzles respectively formed in the droplet discharge device to form a first dot on the test sheet;

a third step of setting a test sheet at the first distance from the droplet discharge device; and a fourth step of discharging at least one droplet toward the test sheet set in the third step from the plurality of nozzles respectively to form a second dot on the test sheet.

In this method, the test sheet is moved along a sheet plane during in at least either the second or fourth step. The moving speeds of the test sheet differ in the second step and the fourth step.

The method also comprises a fifth step of comparing the first dot distribution pattern and the second dot distribution pattern and determining the discharge velocity variance of the plurality of nozzles.

In the fourth step of this testing method, droplets from a plurality of nozzles are discharged toward the test sheet, which moves at a speed different from that of the second step, to print a second dot group. The first dot group is compared with the second dot group to determine the discharge velocity variance of the plurality of nozzles.

With the test sheet moving, the test sheet moves during the time from when a droplet is discharged from the nozzle to when the droplet adheres to the test sheet.

When the speed of the test sheet is high, the distance that the test sheet moves during the time from when a droplet is discharged to when the droplet adheres is greater than when the test sheet speed is low. Thus, droplet adherence positions differ depending on whether the test sheet speed is high or low.

If the droplet is discharged at a high velocity, the time from when the droplet is discharged to when the droplet adheres is short. Thus, the differences in droplet adherence positions do not differ greatly whether the test sheet speed is high or low. But if the droplet is discharged at a low velocity, the time from when the droplet discharged to when the droplet adheres is long. Thus, the differences in droplet adherence positions differ to a greater extent depending on whether the test sheet speed is high or low.

Differences in the adherence positions of droplets discharged when the test sheet is moving at a high speed and low speed are measured for each dot and compared to measure the variance in droplet discharge velocity.

BRIEF DESCRIPTION OF THE DRAWINGS

FIG. 5(*b*) is a top view of one of the individual electrodes of FIG. 5(*a*).

DETAILED DESCRIPTION OF THE INVENTION

First Embodiment of the Invention

A first embodiment of an inkjet head test method of the invention is discussed here.

Inkjet Head

Figure 1:
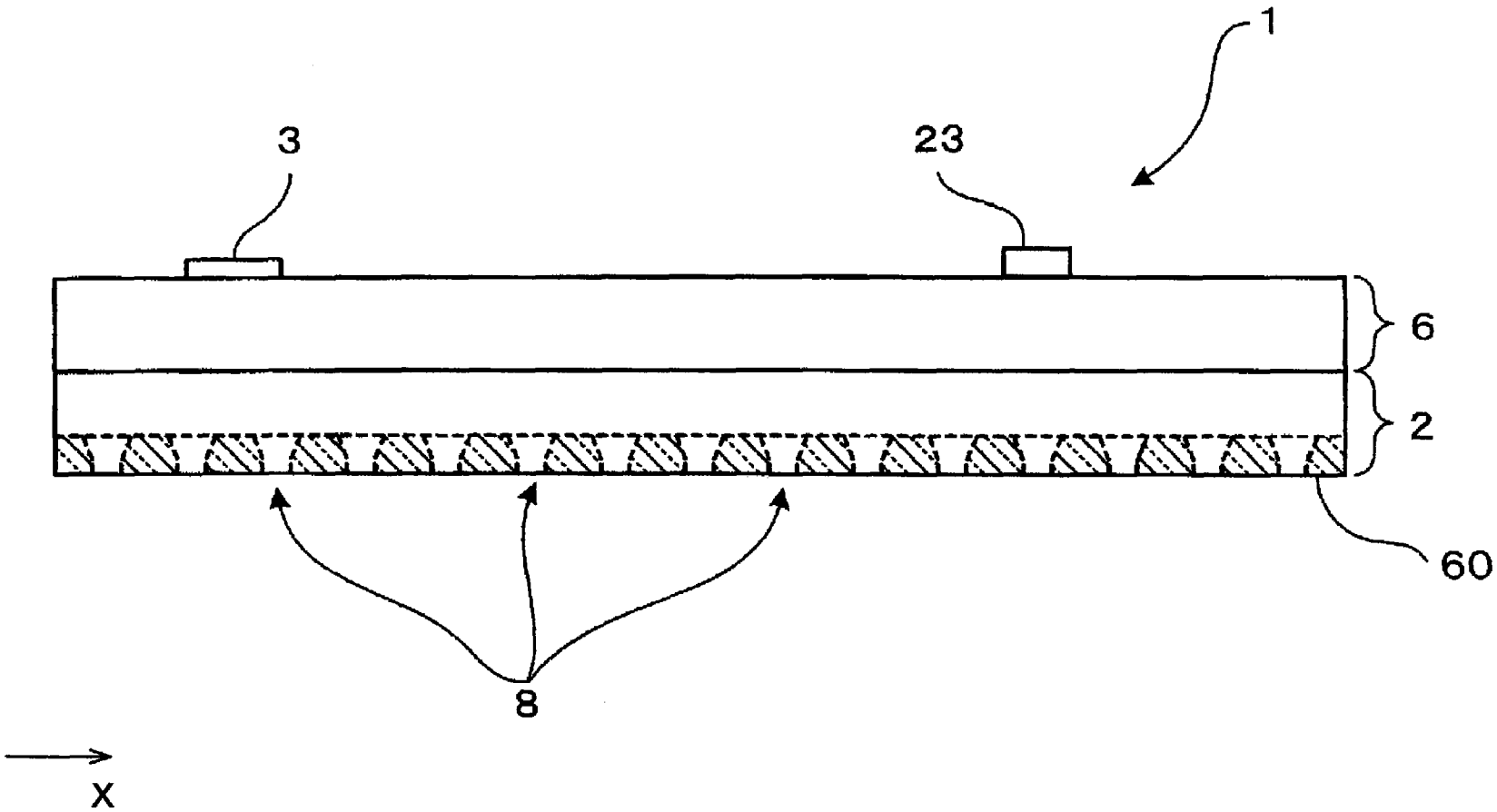
FIG. 1 is a side view of an inkjet head to be tested by the testing methods of the first to third embodiments and a cross-section of the nozzles.
Figure 2:
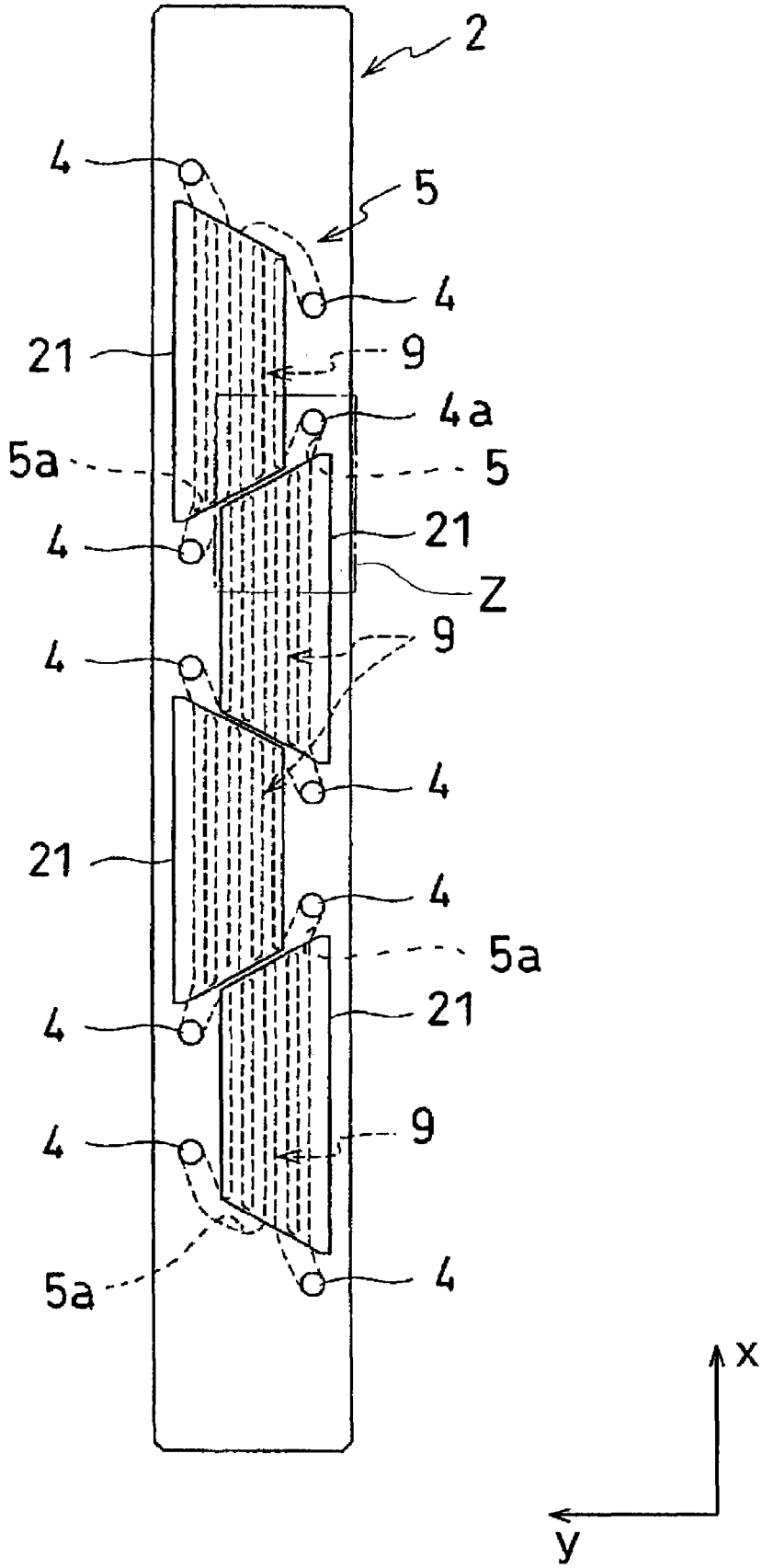
FIG. 2 is top view of the flow channel unit.

FIG. 1 is a side view of inkjet head 1 to be tested with the present testing method. Inkjet head 1 is an elongated shape in the x direction in FIG. 1. When printing is accomplished with inkjet head 1, printing paper is provided on the lower side of lower surface 60 of inkjet head 1. Given that the direction from in front of to behind the plane of the page of FIG. 1 is the y direction, the printing paper is sent in the y direction. Inkjet head 1 comprises flow channel unit 2 that discharges ink, ink supply unit 6 that guides ink to flow channel unit 2, and four actuator units 21 (FIG. 2).

Ink supply port 3 is formed on the upper portion of ink supply unit 6. Ink is supplied from outside through ink supply port 3. Some ink flow channels are formed within ink supply unit 6. One end of the ink flow channels is connected to ink supply port 3. The other end of the ink flow channels opens to the lower surface of ink supply unit 6. Flow channel unit 2 and actuator units 21 are secured to the lower surface of ink supply unit 6. The openings of the ink flow channels formed on the lower surface of ink supply unit 6 is connected with ink inflow ports 4 of manifolds 5 formed in flow channel unit 2 that will be discussed later. When ink is supplied to ink supply port 3, the supplied ink travels along the ink flow channels within ink supply unit 6, and flows into manifolds 5 of flow channel unit 2.

Ink supply unit 6 comprises cable connector 23. Cable connector 23 comprises a plurality of electrodes. Each electrode is connected to individual electrodes 19 of actuator unit 21 that will be discussed later. Control cable 25 to be discussed later is connected to cable connector 23.

Flow channel unit 2 is secured to the lower surface of ink supply unit 6. As FIG. 1 shows, a plurality of nozzles 8 is formed on the lower surface of flow channel unit 2, the lower surface thereof being nozzle surface 60. Flow channel unit 2 discharges ink from nozzles 8.

FIG. 2 is a plan view of flow channel unit 2 seen from above. As FIG. 2 shows, four actuator units 21 are secured to the upper surface of flow channel unit 2. In greater detail, actuator units 21 are sandwiched between ink supply unit 6 and flow channel unit 2. A plurality of manifolds 5 is formed inside flow channel unit 2. One end of manifolds 5 opens to the upper surface of flow channel unit 2 (inflow port 4 in FIG. 2). Inflow ports 4 are connected to the ink flow channels in ink supply unit 6. The other end of manifolds 5 branches to form sub-manifolds 5*a*. As discussed in more detail later, sub-manifolds 5*a* further branch to form a plurality of flow channels leading to nozzles 8 inside flow channel unit 2. Ink is supplied from the ink flow channels of ink supply unit 6 to inflow ports 4. The supplied ink, via manifolds 5 and sub-manifolds 5*a*, is supplied to the flow channel leading to nozzles 8.

Figure 4:
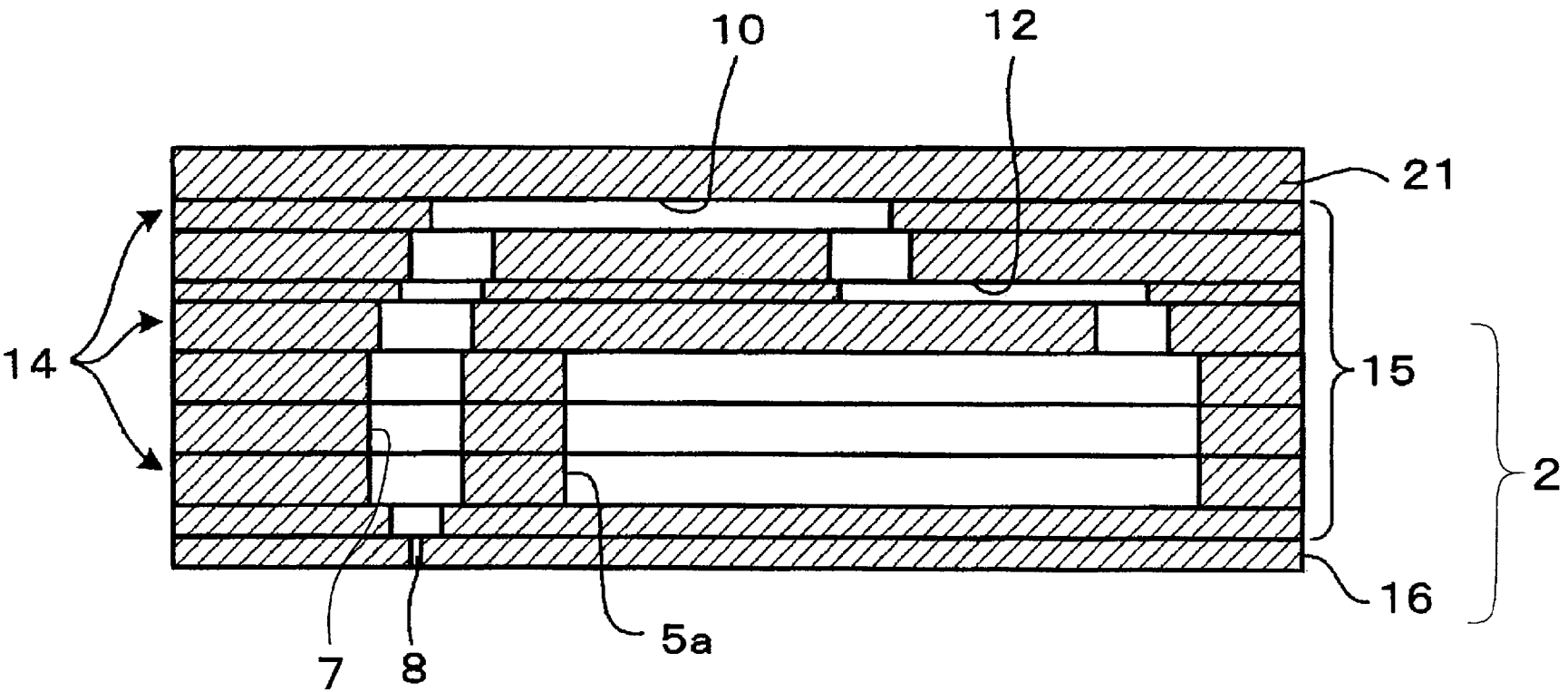
FIG. 4 is a expanded cross-section along line IV-IV of FIG. 3.

FIG. 4 is a cross-section of flow channel unit 2 and shows in expanded view the flow channel leading to one of nozzles 8. As FIG. 4 shows, flow channel unit 2 comprises layered member 15 and nozzle plate 16, in which penetrating holes (nozzle 8) are formed. Layered member 15 comprises a plurality of metal plates 14 that are layered and in which penetrating holes are formed with etching. The flow channels (including manifold 5 and sub-manifold 5*a*) are formed by penetrating holes of metal plates 14 and nozzle plate 16 within flow channel unit 2. As FIG. 4 shows, branching flow channel 7 that branches from sub-manifold 5*a* is formed within flow channel unit 2. The other end of branching flow channel 7 is connected to nozzle 8. Branching flow channel 7 guides ink within sub-manifold to nozzle 8. Nozzle 8 discharges ink supplied from branching flow channel 7. Pressure chamber 10 is formed in the central portion of branching flow channel 7. The upper surface of pressure chamber 10 opens to the upper surface of flow channel unit 2. The opening is closed by actuator unit 21. Pressure chamber 10 is filled by ink supplied from the upstream end of branching flow channel 7. Aperture 12 is formed on the upstream end of pressure chamber 10 of branching flow channel 7.

Figure 3:
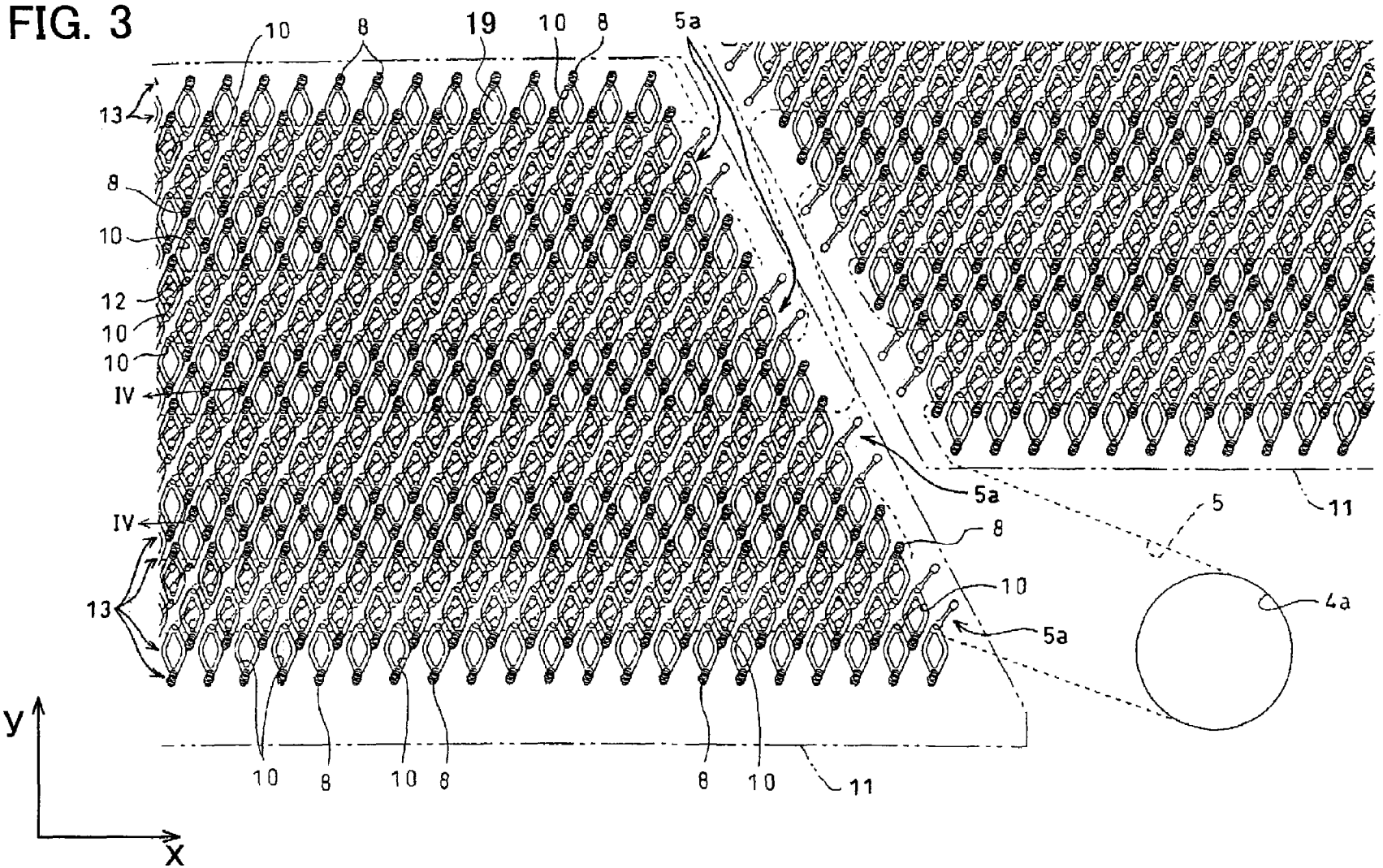
FIG. 3 is an expanded view of region Z of FIG. 2.

Nozzle 8 as well as corresponding pressure chamber 10, branching flow channel 7, and aperture 12 are formed in region 9 overlapping with actuator unit 21 (FIG. 2). FIG. 3 is an expanded view of region Z in FIG. 2. The flow channels in flow channel unit 4 and individual electrodes 19, which will be discussed later, are indicated with solid lines. As FIG. 3 shows, a plurality of nozzles 8 as well as corresponding pressure chambers 10, branching flow channels 7, and apertures 12 are formed in a staggered configuration in region 9. The figure also shows the diamond-like shape of pressure chambers 10.

As FIG. 2 shows, four actuator units 21 are secured respectively to the upper surface of flow channel unit 2. As noted earlier, actuator units 21 are sandwiched between flow channel unit 2 and ink supply unit 6. Each actuator unit 21 has a trapezoidal shape.

Figure 5:
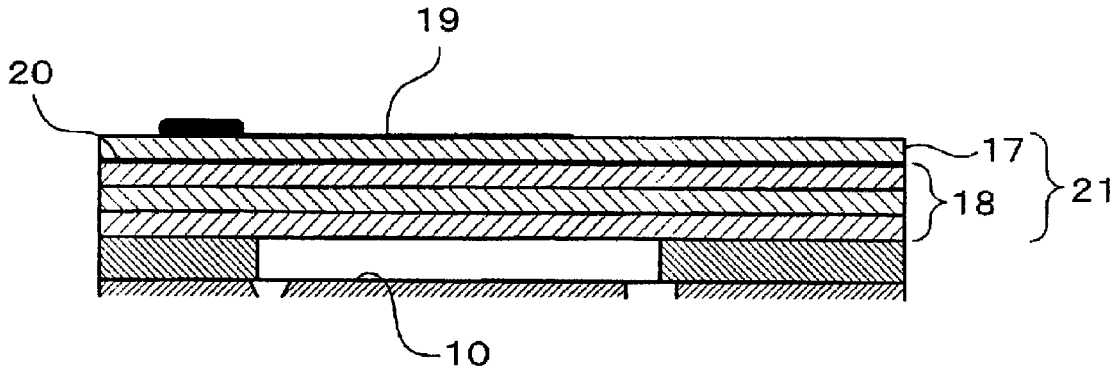
FIG. 5(*a*) is an expanded cross-section of one of the actuator units.
Figure 5:
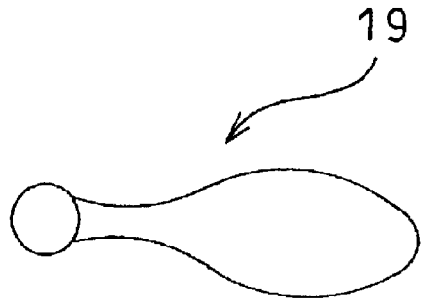

FIG. 5 is an expanded cross-section of one of actuator units 21. As FIG. 5 shows, actuator units 21 are constituted by vibrating plate 18 secured to the lower surface of piezoelectric layer 17. Piezoelectric layer 17 comprises a ferroelectric ceramic material and in this embodiment comprises a ceramic material of lead zirconium titanium oxide (PZT). The thickness of piezoelectric layer is about 15 μm. Vibrating plate 18 is a metallic plate. The lower surface of vibrating plate 18 is secured to flow channel unit 2.

The individual electrodes 19 are formed on the upper surface of piezoelectric layer 17 at locations directly above pressure chambers 10 of flow channel unit 2. Individual electrodes 19 formed from Ag—Pd metal. As FIG. 5(*b*) shows, Individual electrodes 19 have a diamond-like shape, a portion of which is extended outwards. A land is formed at this extending portion. The land has a circular shape with a diameter of approximately 160 μm and comprises gold that includes glass frits. Each land is connected to the respective electrodes of cable connector 23. Electric signals are input into the electrodes of cable connector 23 to allow electric signals to be input into individual electrodes 19. As FIG. 3 shows, individual electrodes 19 are all formed directly above pressure chamber 10.

Common electrode 20 is formed over almost the entire lower surface of piezoelectric layer 17. Common electrode 20 is grounded at a position not shown in the drawings. Common electrode 20 is formed from Ag—Pd metal.

Next, the discharge of ink from the nozzles 8 will be discussed. Inkjet head 1 is driven by changing the potential of individual electrodes 19 of actuator units 21. Normally, the potential of individual electrodes 19 is maintained at 0 V. And as was mentioned earlier, common electrode 20 is grounded. Therefore, individual electrodes 19 and common electrode 20 have the same potential. When an electric signal is input into one of individual electrodes 19, and individual electrode 19 takes on a positive potential, an electric field is formed between individual electrode 19 and common electrode 20. When this happens, the resulting electric field acts on piezoelectric layer 17 and deforms a position corresponding to individual electrode 19 of actuator unit 21. Deformation of actuator unit 21 results in a change in the volume of pressure chamber 10. When the volume of pressure chamber 10 changes, the pressure of the ink within it changes. When the ink in pressure chamber 10 is pressurized, the pressure results in ink discharge from nozzle 8. When the pressure of the ink in pressure chamber 10 decreases, ink flows in from branching flow channel 7 on the side of aperture 12 to pressure chamber 10. In summary, the input of an electric signal into one of individual electrodes 19 causes ink to be discharged from nozzle 8 corresponding to individual electrode 19. Selecting individual electrode 19 into which an electric signal will be input allows nozzle 8 that will discharge ink to be selected.

Electric signal input into individual electrodes 19 is accomplished by connecting control cable 25 to cable connector 23 and inputting electric signals into control cable 25.

Test Pattern Printing Device

Figure 6:
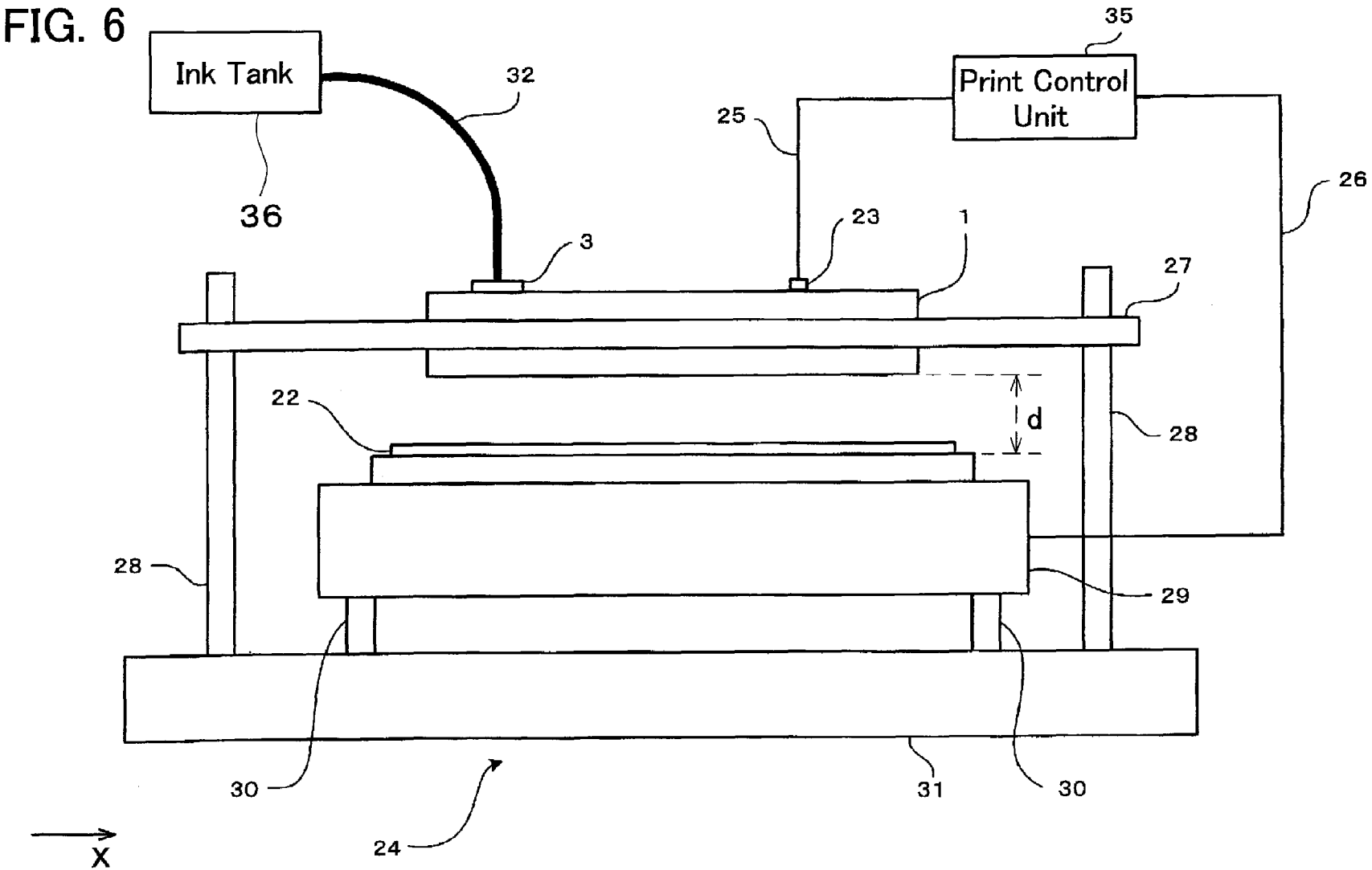
FIG. 6 is a front view of the test pattern printing device used in the first embodiment.

Test pattern printing device 24 of the present embodiment is discussed in reference to FIG. 6. Inkjet head 1 is attached to test pattern printing device 24 and test pattern printing is accomplished with the driving of inkjet head 1. Inkjet head 1 is attached to test pattern printing device 24 so that rightward direction of FIG. 6 is the x direction and the direction from in front of to behind the plane of the page is the y direction. Test pattern printing device 24 comprises base platform 31; printing platform rail 30; printing platform 29; two support columns 28; head securing plate 27; ink supply tube 32; ink tank 36; and print control unit 35.

Base platform 31, disposed at the lowest portion of test pattern printing device 24, serves as the base for the device as a whole. Printing platform rail 30 is provided on base platform 31. Printing platform rail 30 is composed of two rails and extends in the y direction. Printing platform 29 is provided on printing platform rail 30. Test pattern printing device 24 is configured so that printing paper 22 can be provided on the upper surface of printing platform 29. Printing platform 29 is connected to print control unit 35 via control cable 26. Printing platform 29, driven by the input of control signals from print control unit 35, moves along printing platform rail 30. In other words, printing platform 29 moves in the y direction. Printing paper 22 provided on printing platform 29, therefore, also moves in the y direction.

Two support columns 28 are provided standing near each end of base platform 31. Head securing plate 27 spans between two support columns 28. A penetrating hole approximating the shape of inkjet head 1 is formed at the central portion of head securing plate 27. Inkjet head 1 is attached to the penetrating hole during test pattern printing. Head securing plate 27 can be slid vertically relative to support columns 28. Vertically sliding head securing plate 27 allows distance d between inkjet head 1 attached to head securing plate 27 and printing paper 22 on printing platform 29 (hereafter, discharge distance d) to be changed. Discharge distance d can be measured from the amount of sliding of head securing plate 27.

Ink tank 36 is filled with ink. Ink tank 36 is connected to tube 32. The other end of tube 32 is connected to ink supply port 3 of inkjet head 1 during test pattern printing. Ink within ink tank 36 is supplied to ink supply port 3 via tube 32.

Print control unit 35 is a calculating device composed of a computer or the like. Control unit 35 is connected to printing platform 29 via control cable 26. Print control unit 35 causes printing platform 29 to move in the y direction by inputting control signals into printing platform 29. Print control unit 35 is connected to one end of control cable 25. During test pattern printing, the other end of control cable 25 is connected to cable connector 23 of inkjet head 1. Print control unit 35 inputs electric signals into individual electrodes 19 of inkjet head 1 via control cable 25 and cable connector 23.

Inkjet head 1 is attached to the penetrating hole of head securing plate 27 during test pattern printing. Control cable 25 is connected to cable connector 23 of inkjet head 1. Tube 32 is connected to ink supply port 3 of inkjet head 1. Printing paper 22 is provided on printing platform 29.

When print control unit 35 inputs an electric signal into one of individual electrodes 19 of inkjet head 1, ink is discharged from nozzle 8 corresponding to individual electrode 19. Print control unit 35 inputs an electric signal into a plurality of individual electrodes 19, so ink is discharged from a plurality of the nozzles 8 corresponding to individual electrodes 19. The discharged ink adheres to printing paper 22. Print control unit 35 also inputs control signals into printing platform 29. At this time, printing platform 29 moves in the y direction. Printing paper 22 provided on printing platform 29 also moves in the y direction. When printing paper 22 is moved in the y direction, the position on printing paper 22 where the ink discharged from inkjet head 1 adheres changes. Sliding head securing plate 27 vertically allows discharge distance d between inkjet head 1 and printing paper 22 to be changed. In other words, ink can be discharged from inkjet head 1 at differing discharge distances d.

Ink Adhering Positions

The positions of ink adherence during test pattern printing with test pattern printing device 24 are discussed.

Ink discharged from nozzles 8 in test pattern printing travels through the air and adheres on printing paper 22. If nozzles 8 are manufactured as designed in inkjet head 1, ink is discharged from nozzles 8 formed at the designed positions to directly below, adhering at the target positions as designed. But manufacturing all of nozzles 8 as designed is very difficult. In actuality, therefore, ink is discharged from nozzles 8 formed at positions not coinciding with the designed positions and in directions not coinciding with the designed angles. The discharged ink therefore adheres at positions deviating from the designed target positions.

Figure 7:
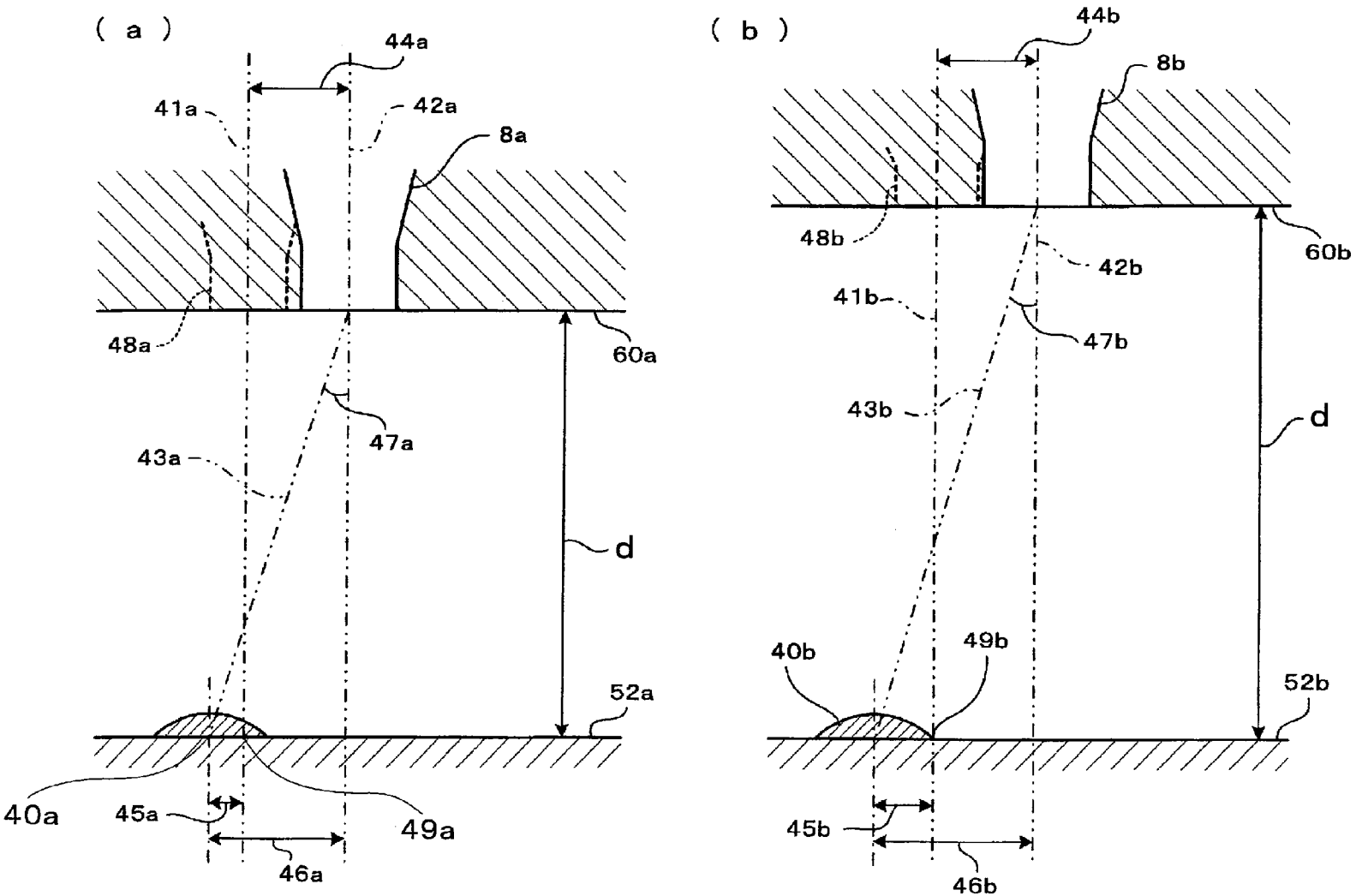
FIGS. 7(*a*) and 7(*b*) illustrate the discharge of ink from a nozzle of the inkjet head of FIG. 1.

FIG. 7 illustrates an adhering position of ink discharged from one of nozzles 8. Reference number 48*a* in FIG. 7(*a*) is the nozzle as designed, reference number 41*a* is the nozzle position as designed, and reference number 49*a* is the designed target position. The ink discharge angle as designed is directly downward. Reference number 8*a* is an actually formed nozzle, reference number 42*a* is an actual nozzle position, reference number 40*a* is an actual ink adhering position, and reference number 47*a* is an actual ink discharge angle. Reference number 60*a* is the nozzle surface, and reference number 52*a* is the recording surface of printing paper 22.

As the figure shows, nozzle 8*a* is formed at position 42*a* deviating from nozzle position 41*a* as designed. The deviation of nozzle 8*a* from nozzle 48*a* as designed (hereinafter sometimes referred to as nozzle position deviation) is 44*a*. Ink is discharged from nozzle 8*a* in a direction deviating from directly downward, which is the discharge angle as designed. The deviation between the discharge angle as designed and the discharge angle of nozzle 8*a* (hereinafter sometimes referred to as the discharge angle deviation) is 47*a*. Ink is discharged from nozzle 8*a* at a high velocity, so it travels almost linearly. Ink therefore travels in the path shown by reference number 43*a* and adheres to the position 40*a*, forming a dot. As such, the deviation in the position of ink adherence caused by discharge angle deviation 47*a* is deviation 46*a*. The deviation between designed target position 49*a* and actual ink adherence position 40*a* (hereinafter sometimes referred to as the ink adherence position deviation or dot position deviation) is the sum of nozzle position deviation 44*a* and ink adherence position deviation 46*a* attributable to discharge angle deviation 47*a*.

As FIG. 7(*b*) shows, when discharge distance d is lengthened, ink adherence position deviation 45*b* similarly is the sum of nozzle position deviation 44*b* and ink adherence position deviation 46*b* attributable to discharge angle deviation 47*b*. In this case, ink adherence position deviation 46*b* attributable to discharge angle deviation 47*b* changes according to discharge distance d, so deviation 45*a* and deviation 45*b* differ.

Figure 8:
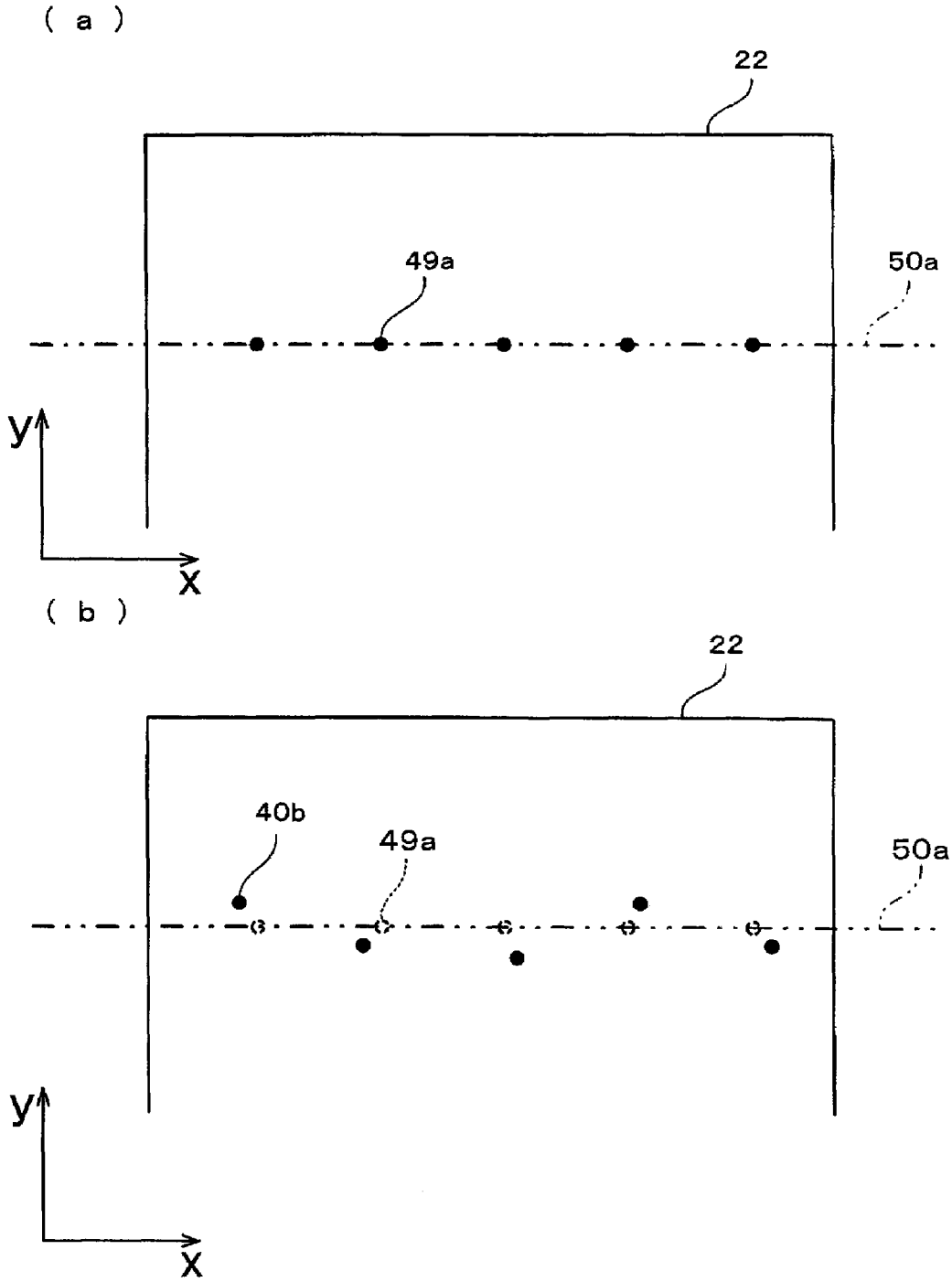
FIGS. 8(*a*) and 8(*b*) illustrate ink adherence positions.

FIG. 8(*a*) illustrates ink adherence positions assuming ink discharge from ideal inkjet head 1 manufactured as designed. FIG. 8(*a*) shows ink adherence positions in the case of ink discharge from five of nozzles 8 aligned equidistantly and linearly in the x direction. If inkjet head 1 is manufactured as designed, ink will adhere to positions identical to designed target positions 49*a*. So as shown in FIG. 8(*a*), ink adheres to positions identical to target positions 49*a* as designed aligned equidistantly on line 50*a*. FIG. 8(*b*), on the other hand, illustrates the discharge of ink under similar conditions from actual inkjet head 1. As the figure shows, if nozzles 8 are not manufactured as designed, ink adheres at positions deviating from designed target positions 49*a*, and dots 40*a* are formed.

Figure 9:
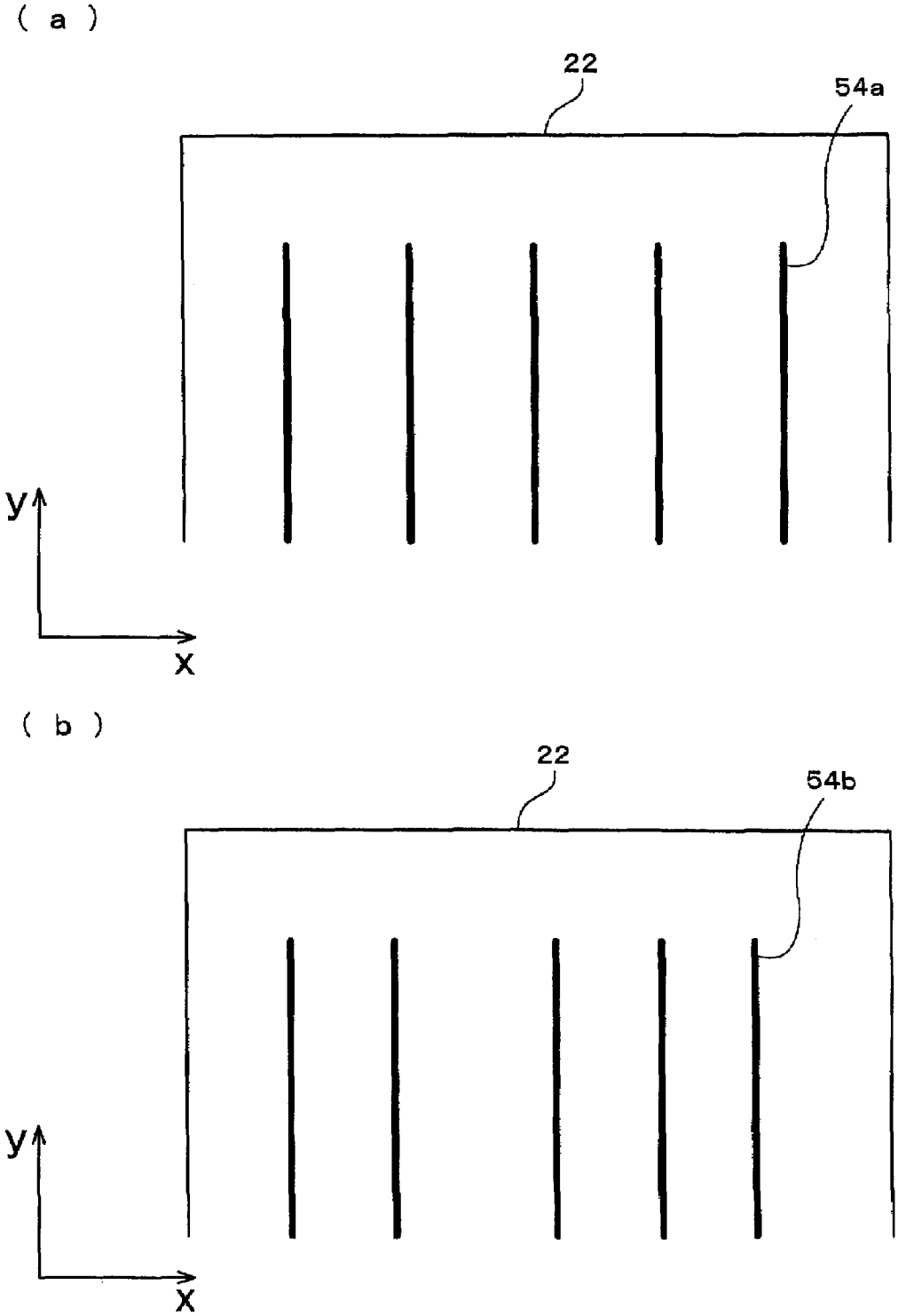
FIGS. 9(*a*) and 9(*b*) illustrate ink adherence positions.

Deviation in the ink adherence positions can be better visually identified by continually discharging ink while moving the paper. FIG. 9(*a*) illustrates printing on paper assuming continuous ink discharge from ideal inkjet head 1 while the paper is moved in the y direction. As the figure shows, parallel lines 54*a* equidistantly aligned on printing paper 22 are drawn with ideal inkjet head 1. FIG. 9(*b*), on the other hand, illustrates the discharge of ink under similar conditions from actual inkjet head 1. As the figure shows, parallel lines 54*b* with differing spacing are drawn on printing paper 22 with actual inkjet head 1 because the ink adherence positions deviate from the designed target positions.

In addition, in a testing step of the inkjet head 1 to be discussed later, ink is discharged from a plurality of nozzles 8 aligned equidistantly in the x direction and y direction from among nozzles 8 of inkjet head 1.

Figure 14:
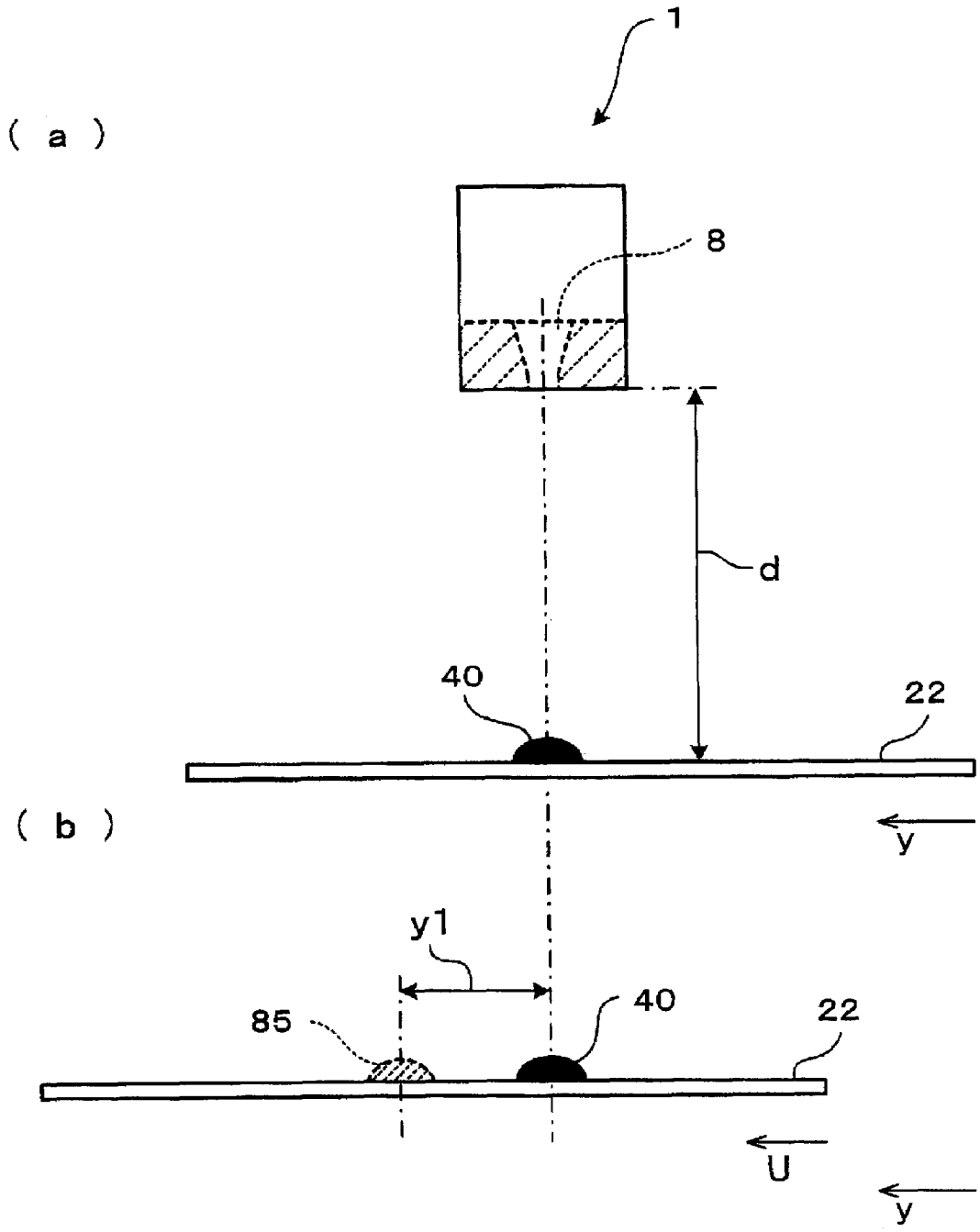
FIGS. 14(*a*) and 14(*b*) illustrate variance in ink discharge velocities.

When ink is discharged from inkjet head 1, while moving printing paper 22, the ink adherence position varies according to the ink discharge velocity. FIG. 14(*a*) shows the ink adherence position when ink is discharged from one of nozzles 8 with printing paper 22 stopped, and FIG. 14(*b*) shows ink adherence position when ink is discharged from one of nozzles 8 at a discharge distance identical to that of FIG. 14(*a*) while printing paper 22 is moved in the y direction at speed U. FIG. 14 assumes that nozzle 8 discharge angle is as designed.

As FIG. 14(*a*) shows, the position directly below nozzle 8 becomes ink adherence position 40 when printing paper 22 is stopped. But when ink is discharged while printing paper 22 is moved, printing paper 22 moves during the time from when ink is discharged from the nozzle 8 to when the ink adheres to the printing paper 22. Ink discharged at a high velocity takes a short time from discharge to adherence to the printing paper 22. Distance y1, therefore, is shortened. But ink discharged at a low velocity takes a long time from discharge to adherence to the printing paper 22. Distance y1, therefore, is lengthened.

Figure 21:
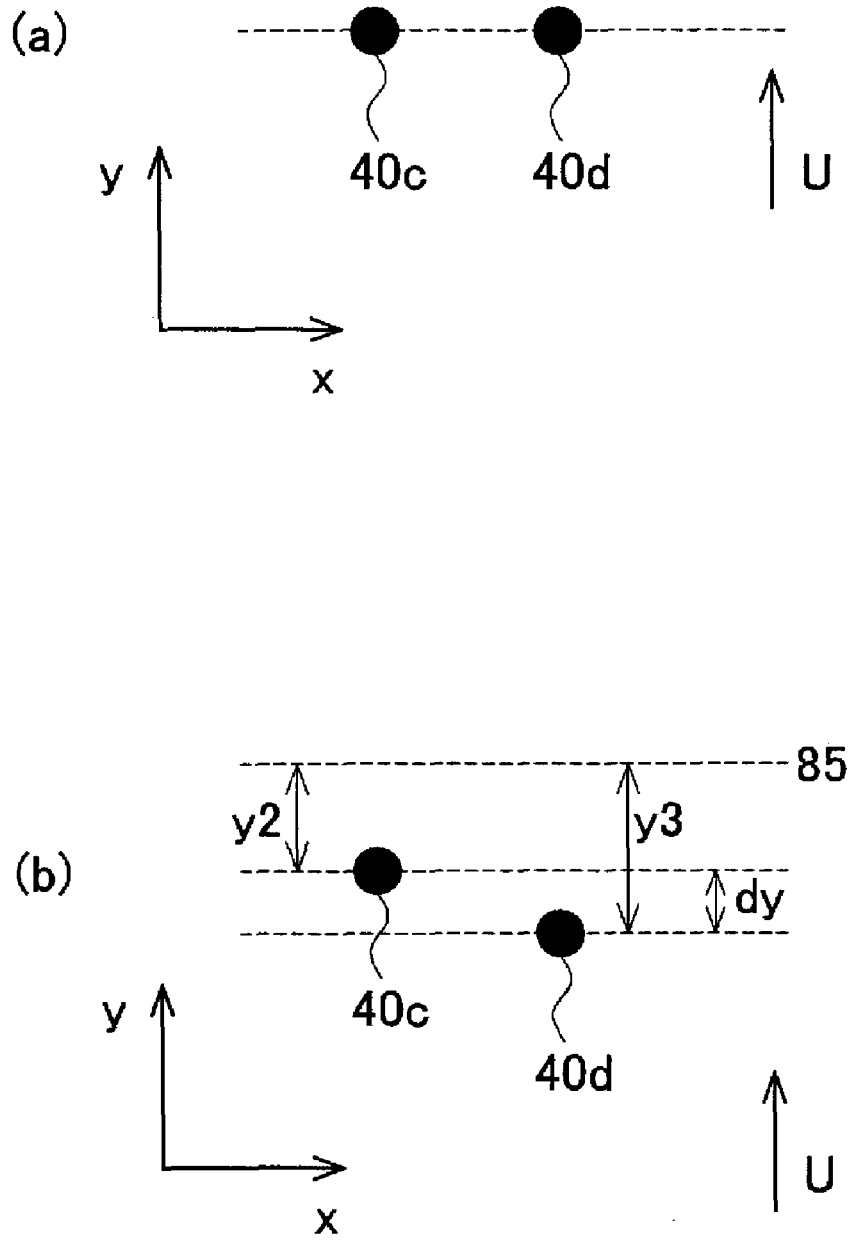
FIGS. 21(*a*) and 21(*b*) illustrate variance in ink discharge velocities.

FIG. 21 shows ink adherence positions 40*c* and 40*d* in a situation assuming ink discharge from neighboring nozzles 8 in the x direction of an inkjet head 1 whose nozzle positions and discharge angles are as designed and whose ink discharge velocity differs. FIG. 21(*a*) shows when ink is discharged with printing paper 22 stopped, and FIG. 21(*b*) shows when ink is discharged with printing paper 22 moving in the y direction at speed U. Ink adheres the positions directly below nozzles 8 when discharged with printing paper 22 stopped. The position in the y direction of ink adherence positions 40*c* and 40*d* are therefore identical. But when ink is discharged while printing paper 22 is moved at speed U, the ink adheres at a position deviating from target position 85, which was directly below nozzle 8 at the instant the ink droplet was discharged. Moreover, the deviation between the target position 85 and ink adherence positions 40*c* and 40*d* varies according to the ink discharge velocity. In FIG. 21(*b*), deviation y2 of ink adherence position 40*c* is less than deviation y3 of ink adherence position 40*d*. This reveals that the discharge velocity of the ink adhering to ink adherence position 40*c* was greater.

Printing Paper

Next, the printing paper used for test pattern printing is discussed. A variety of test sheets including printing paper are used in test pattern printing. But as is discussed later, ink adherence positions must be accurately determined, so printing paper that suitably absorbs ink is preferable. The recording surface of the test sheet therefore is preferably formed from an ink-absorbing layer having a swelling characteristic formed from gelatin, polyvinyl alcohol, PVP, PEO, or the like. The recording surface may alternately be formed from a porous ink-absorbing layer formed by adding an appropriate organic component to fine particles of an inorganic component such as SiO or $Al_2O_3$. It is further preferable that surface roughness Ra of the recording surface is not more than 2.0 μm. Employed in this embodiment is printing paper whose recording surface is formed from ink-absorbing layer having a swelling characteristic with surface roughness Ra of 1.5 μm.

Test Pattern Measuring Device

Figure 10:
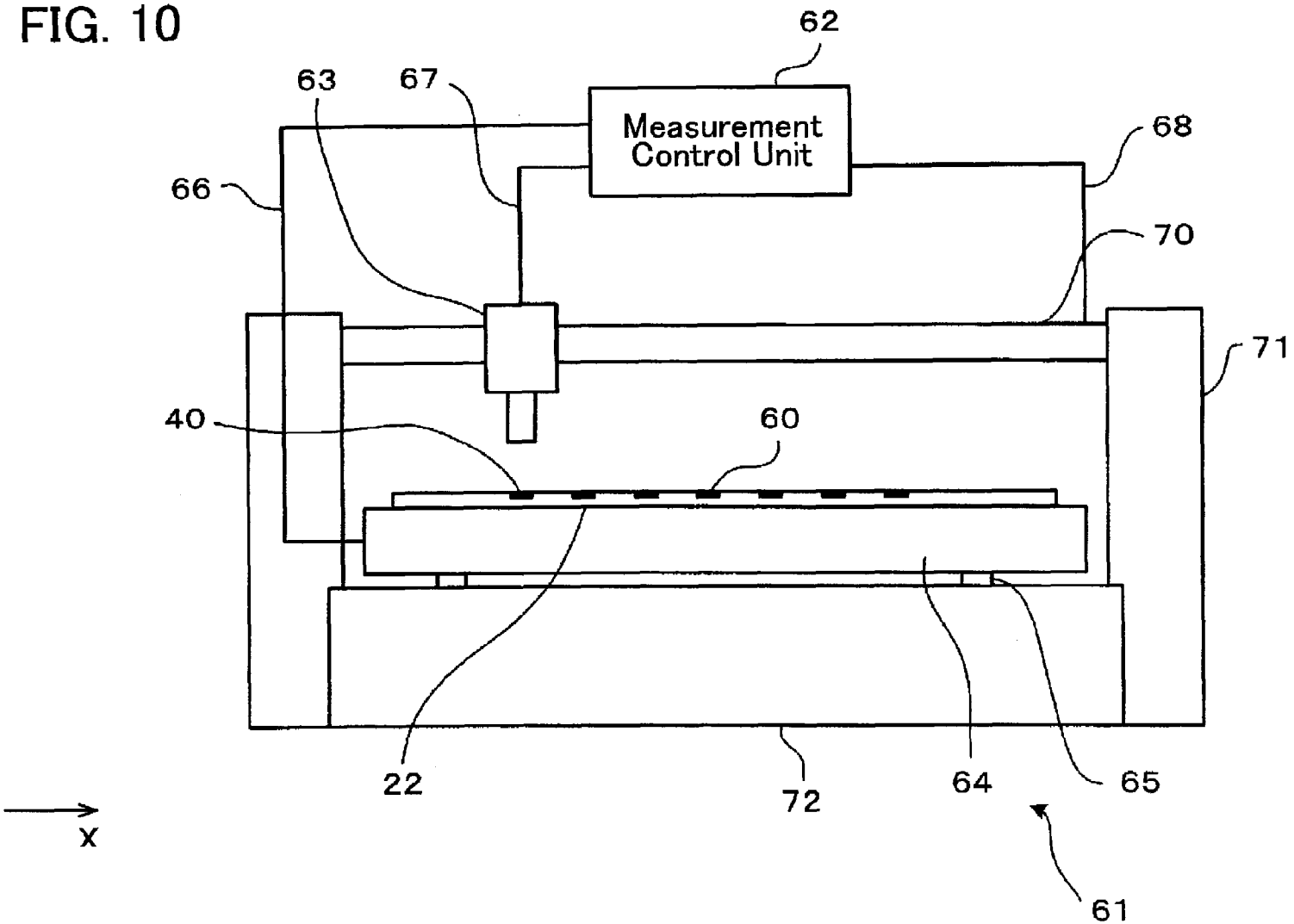
FIG. 10 is a front view of the test pattern measuring device used in the first embodiment.

Test pattern measuring device 61 of the present embodiment is discussed in reference to FIG. 10. Test pattern measuring device 61 measures the positions of dots on printing paper 22 onto which a test pattern has been printed and calculates the positions and discharge angles of nozzles 8. Test pattern measuring device 61, with the rightward direction of FIG. 10 as the x direction and the direction from in front of to behind the plane of the page as the y direction, measures dot positions. Test pattern measuring device 61 comprises base platform 72, measuring platform rail 65, measuring platform 64, two support columns 71, camera attachment rod 70, camera 63, and measurement control unit 62.

Base platform 72, disposed at the lowest portion of test pattern measuring device 61, serves at the base for the device as whole. Measuring platform rail 65 is provided on base platform 72. Measuring platform rail 65 is composed of two rails and extends in the y direction of FIG. 10. Measuring platform 64 is provided on measuring platform rail 65. Test pattern measuring device 61 is configured so that printing paper 22 can be provided on the upper surface of measuring platform 64. Measuring platform 64 is connected to measurement control unit 62 via control cable 66. Measuring platform 64, driven by the input of control signals from measurement control unit, moves along measuring platform rail 65. In other words, measuring platform 64 moves in the y direction. Printing paper 22 provided on measuring platform 64, therefore, also moves in the y direction. The amount of movement of measuring platform 64 is read by measurement control unit 62 via control cable 66.

Two support columns 71 are provided standing near each end of the base platform 72. Camera attachment rod 70 spans between two support columns 71. Camera 63 is attached to camera attachment rod 70 so that movement is possible along camera attachment rod 70 (i.e., in the x direction). Camera 63 is attached so that the measurement range is in the downward direction. During test pattern measurement, camera 63 photographs the recording surface of printing paper 22 provided on measuring platform 64. Camera attachment rod 70 has a driving mechanism that moves camera 63. The driving mechanism is connected to measurement control unit 62 via control cable 68. The input of control signals by measurement control unit 62 to the driving mechanism causes the driving mechanism to operate, moving camera 63 in the x direction. The amount of movement of camera 63 in the x direction is read by measurement control unit 62 via control cable 68.

Measurement control unit 62 is a calculating device composed of a computer or the like. Control unit 62 is connected to measuring platform 64 via control cable 66. Measurement control unit 62, inputting control signals into measuring platform 64, causes measuring platform 64 to move in the y direction. At this time, measurement control unit 62 reads the amount of movement of measuring platform 64 and calculates the position in the y direction of measuring platform 64. Measurement control unit 62 is connected to camera attachment rod 70 via control cable 68. Measurement control unit 62, inputting control signals into camera attachment rod 70, causes camera 63 to move in the x direction. At this time, measurement control unit 62 reads the amount of movement of camera 63 and calculates the position in the x direction of camera 63. Measurement control unit 62 is connected to camera 63 via control cable 67. Measurement control unit 62 reads image data on printing paper 22 sent from camera 63. Measurement control unit 62 causes camera 63 to move in the x direction and measuring platform 64 to move in the y direction to change the measurement range of camera 63 in the x and y directions. In other words, the position in the x direction of camera 63 and the position in the y direction of measuring platform 64 indicate the position of the measurement range of camera 63. Measurement control unit 62 moves the measurement range of camera 63 to measure the positions of dots printed on printing paper 22.

Measurement control unit 62 stores in memory a standard dot distribution pattern of inkjet head 1. The standard dot distribution pattern is data indicating the designed target positions of each of nozzles 8 (e.g., 41*a* in FIG. 7(*a*)).

Inkjet Head Testing Method

Figure 15:
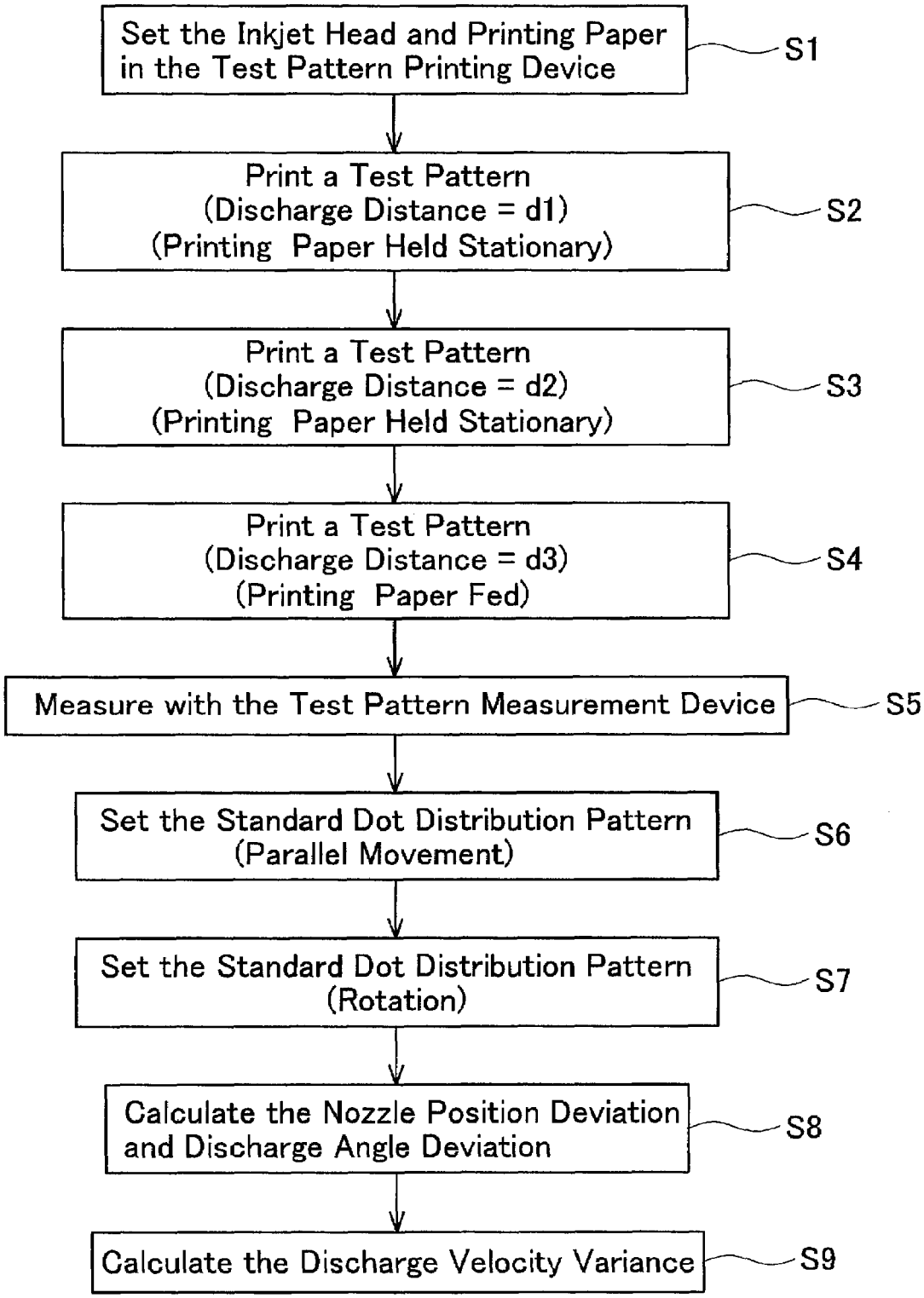
FIG. 15 is a flowchart showing the inkjet head testing process of the first embodiment.

Next, a method for testing inkjet head 1 using test pattern printing device 24 and test pattern measuring device 61 is discussed. This testing method evaluates deviations in the position and discharge angle as well as variance in the discharge velocity of nozzles 8 of inkjet head 1. This testing method is carried out per the flowchart shown in FIG. 15.

In step S1, inkjet head 1 and printing paper 22 are set in test pattern printing device 24. Inkjet head 1 is attached to head securing plate 27 so that the x and y directions thereof are identical to the x and y directions of test pattern printing device 24. Printing paper 22 is set on printing platform 64 so that the recording surface faces upward.

In step S2, test pattern printing device 24 is activated with a discharge distance of d1. At this time, print control unit 35 inputs electric signals into inkjet head 1. Ink is therefore discharged from nozzles 8 of inkjet head 1, and a test pattern (hereinafter referred to as test pattern T1, with the dots of test pattern T1 referred to as the first dots) is printed on printing paper 22. In step S2, ink is discharged from a plurality of nozzles 8 aligned equidistantly in the x direction and y direction from among nozzles 8 of inkjet head 1. Ink is discharged from these same nozzles 8 in steps S3 and S4, which will be discussed later.

When test pattern T1 has been printed, printing paper 22 is fed the designated amount. Directly beneath inkjet head 1 (i.e., the target positions of nozzles 8), therefore, is a position where printing paper 22 has not been printed on.

In step S3, test pattern printing device 24 is activated as in step S2 with a discharge distance of d2 (>d1). Ink is therefore discharged from the same nozzles as in step S2, and a test pattern (hereinafter referred to as test pattern T2, with the dots of test pattern T2 referred to as the second dots) is printed on printing paper 22. When test pattern T2 has been printed, printing paper 22 is fed the designated amount as in step S2.

In step S4, test pattern printing device 24 is activated with a discharge distance of d2 and the mode switched to one in which the test pattern is printed as printing paper 22 is moved. Print control unit 35, inputting control signals into printing platform 29, causes printing paper 22 to move in the y direction at speed U. Print control unit 35 outputs electric signals to inkjet head 1 with printing paper 22 moving, causing ink to be discharged from same nozzles 8 as in step S2. A test pattern (hereinafter referred to as test pattern T3, with the dots of test pattern T3 referred to as the third dots) is therefore printed on printing paper 22. Once test pattern T3 has been printed, printing paper 22 is removed from test pattern printing device 24.

In summary, steps S2 to S4 result in the printing of three test patterns T1 to T3 on printing paper 22.

Once the test patterns have been printed on printing paper 22 in steps S1 to S4, the positions of the dots of test patterns T1 to T3 are measured with test pattern measuring device 61. Discharge distances d1 to d2 of steps S2 to S4 are input and stored beforehand in measurement control unit 62 of test pattern measuring device 61. Feeding speed U of printing paper 22 in step S4 is also input and stored in advance in measurement control unit 62. The approximate positions of the dots of the test patterns printed by test pattern printing device 24 and the order the dots are to be measured in are also set beforehand in measurement control unit 62.

In step S5, printing paper 22, on which the test patterns were printed in steps S1 to S4, is set in test pattern measuring device 61. At this time, printing paper 22 is set in test pattern measuring device 61 in a direction (x and y directions) identical to that in which it was set in test pattern printing device 24.

Once printing paper 22 has been set, test pattern measuring device 61 is activated. At this time, measurement control unit 62 controls camera 63 and measuring platform 64 and initiates the measurement of the dot positions.

Measurement control unit 62 activates camera 63. Camera 63 faces directly downward, so camera 63 begins photographing printing paper 22. The image data photographed by camera 63 is input into measurement control unit 62 as needed. Measurement control unit 62 moves camera 63 and measuring platform 64 to move the measurement range of camera 63 to the approximate position of the dot of test pattern T1 to be first measured. Once camera 63 has photographed the dot, measurement control unit 62 recognizes the shape of the dot. The measurement range of camera 63 is moved so that the center of the dot is positioned in the center of the measurement range of camera 63. Once the center of the dot is positioned in the center of the measurement range of camera 63, measurement control unit 62 sets the current position of camera 63 (x coordinate) and the current position of measuring platform 64 (y coordinate) as the origin. Once the origin has been set, measurement control unit 62 moves the measurement range of camera 63 to the next dot of the test pattern T1. Then, the center of the dot is positioned at the center of the measurement range of camera 63 as before. Measurement control unit 62 calculates the x coordinate of the dot from the amount of movement of camera 63 and the y coordinate of the dot from the amount of movement of measuring platform 64. The x and y coordinates thus calculated are stored in measurement control unit 62. Measurement control unit 62 calculates and stores the dot positions (i.e., x and y coordinates) of the test pattern T1 in the order stored in memory. In this manner, measurement control unit 62 calculates and stores the positions of all dots of test pattern T1. Measurement control unit 62, once the measurement of the dot positions of test pattern T1 has concluded, makes similar measurements for test patterns T2 and T3, measuring the dot positions individually for each test pattern.

Measurement control unit 62, after measuring the positions of the dots of test patterns T1 to T3, sets the standard dot distribution pattern. The method for setting the standard dot distribution pattern is discussed here.

Figure 11:
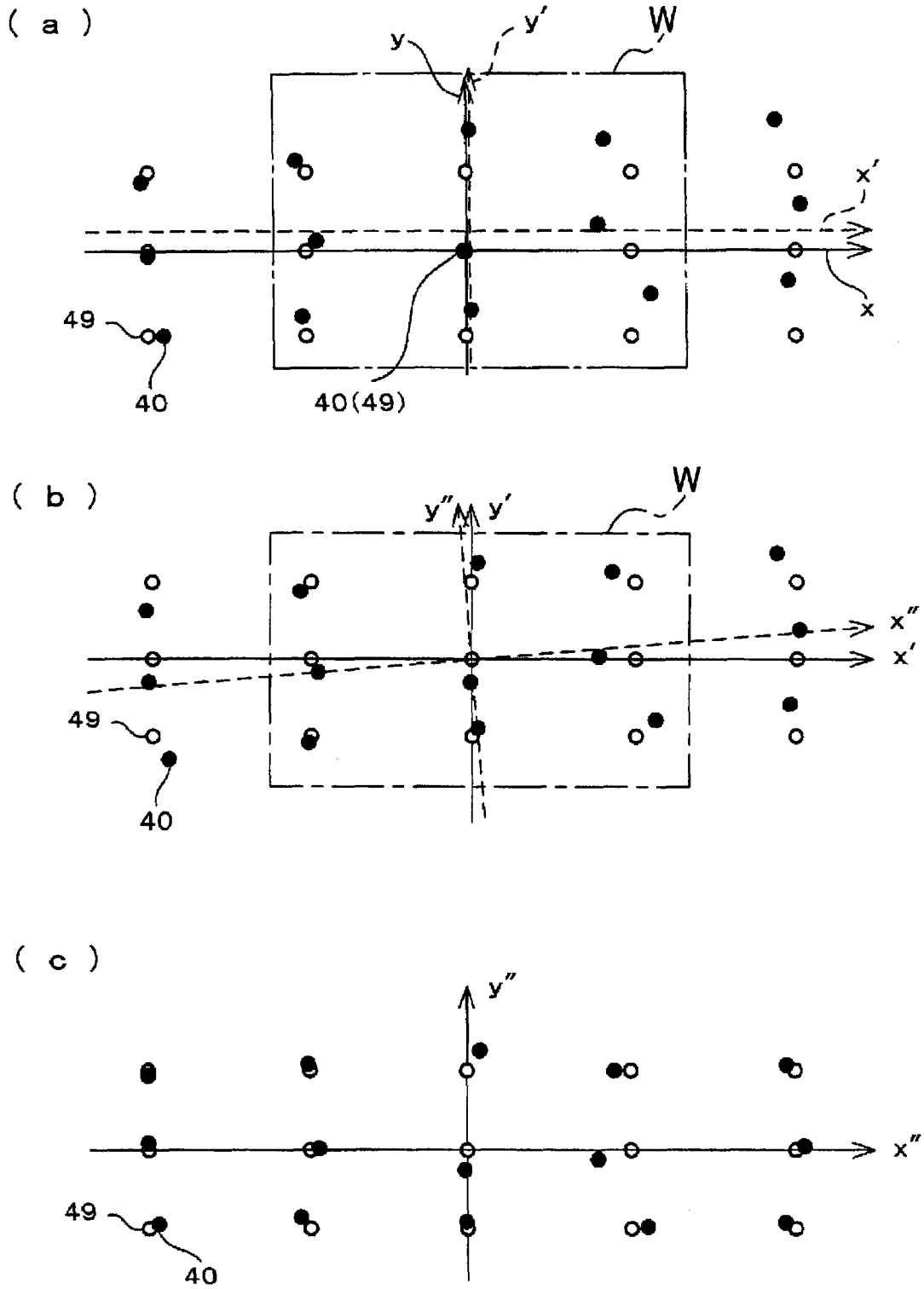
FIGS. 11(*a*), 11(*b*), and 11(*c*) illustrate the setting of the standard dot distribution pattern performed in the testing method of the first embodiment.

As noted earlier, the standard dot distribution pattern is stored in measurement control unit 62. The standard dot distribution pattern is data specifying as x and y coordinates the designed target positions corresponding to each of nozzles 8 that discharge ink in steps S2 to S4. The x and y coordinates of each standard dot position are specified with the standard dot position corresponding to the dot set as the origin in step 6 as the origin. FIG. 11(*a*) illustrates the positional relationship between standard dot positions 49 and each dot 40. As the figure shows, the position of dot 40 matches that of standard dot positions 49 at the origin.

In steps S6 and S7, the standard dot distribution pattern moved relative to the test pattern and set. Standard dot position 49 noted earlier is positioned relative to the origin (i.e., dot 40 set at the origin). But when dot 40 set at the origin deviates highly from the designed target position, standard dot position 49 will deviate highly from the designed target position. Therefore, measurement control unit 62 moves and sets standard dot position 49 to match the designed target position.

In step S6, the standard dot distribution pattern is moved parallel with respect to the test pattern in conjunction with the x and y axes. The parallel movement of the standard dot distribution pattern is carried out in accordance with the deviation between each of dots 40 and standard dot positions 49 corresponding thereto.

In greater detail, measurement control unit 62 first calculates the deviation $\Delta x$ in the x direction and deviation $\Delta y$ in the y direction of dots 40 relative to the corresponding standard dot positions 49. Measurement control unit 62 calculates $\Delta x$ and $\Delta y$ of all of dots 40 in region W in FIG. 11(*a*). Next, measurement control unit 62 calculates mean Mx of deviation $\Delta x$ and mean My of deviation $\Delta y$ of dots 40. Then, measurement control unit 62 performs parallel movement of the standard dot distribution pattern in conjunction with the x and y axes by the calculated the mean Mx and mean My. (In other words, the position of each of dots 40 is subjected to coordinate conversion to a position moved parallel to the plane by −Mx and −My.) With parallel movement of the standard dot distribution pattern by measurement control unit 62 as such, the standard dot distribution pattern, the x axis, and the y axis are set so that the mean deviation in dots 40 from corresponding standard dot positions 49 is minimized. The standard dot distribution pattern is subjected to parallel movement as shown in FIG. 11(*b*). The x and y axes are concurrently subjected to parallel movement to become the x' and y' axes.

In step S8, the standard dot distribution pattern is rotated relative with respect to the test pattern in conjunction with the x' and y' axes. The rotation of the standard dot distribution pattern is carried out in accordance with the deviation between each of dots 40 and standard dot positions 49 corresponding thereto.

In greater detail, measurement control unit 62 first calculates deviation Δx' in the x' direction and deviation Δy' in the y' direction of dots 40 relative to corresponding standard dot positions 49. Next, the formula $$L^2=\Delta x'^2+\Delta y'^2$$

is used to calculate $L^2$, of sum of the squares of the differences of dots 40 and standard dot positions 49. Measurement control unit 62 calculates sum of the squares of the differences $L^2$ of all of dots 40 in region W in FIG. 11(*a*). Mean $ML^2$ of sum of the squares of the differences $L^2$ thus calculated is also determined. Then, measurement control unit 62 rotates the standard dot position pattern in conjunction with the x' and y' axes about the origin by the specified amount of degrees. (In other words, the position of each of dots 40 is subjected to coordinate conversion to a position rotated in the opposite direction by the specified amount of degrees.) Measurement control unit 62, after rotating the standard dot distribution pattern, again calculates mean $ML^2$. Then, mean $ML^2$ before rotation and mean $ML^2$ after rotation are compared. If mean $ML^2$ after rotation is less than the value before rotation, measurement control unit 62 again rotates the standard dot distribution pattern by the specified amount of degrees in the same direction of rotation. If mean $ML^2$ after rotation is greater than the value before rotation, measurement control unit 62 rotates the standard dot distribution pattern by the specified amount of degrees in the opposite direction of rotation. Measurement control unit 62, after rotating the standard dot distribution pattern, again calculates mean $ML^2$ of sum of the squares of the differences $L^2$ of dots 40 and then determines the direction of rotation. As has been discussed, measurement control unit 62 repeats the processes of rotating the standard dot distribution pattern by a specified amount and calculating mean $ML^2$ of sum of the squares of the differences $L^2$ of dots 40 to set the standard dot distribution pattern as well as the x' and y' axes to an angle that minimizes mean $ML^2$. The standard dot distribution pattern is rotated as shown in FIG. 11(*c*). The x' and y' axes are concurrently rotated to become the x" and y" axes.

The standard dot distribution pattern is set in steps S6 and S7 relative to the test patterns T1 and T2. Setting the standard dot distribution pattern with the above-mentioned method allows the standard dot distribution pattern to be set to a position approximately matching the designed target position without the use of a special means for measuring an absolute standard. For the test pattern T3, the standard dot distribution pattern set for the test pattern T2 is set irrespective of the positions of the dots. In other words, the standard dot distribution pattern for the test pattern T3 is subjected in step S6 to parallel movement in the same direction and by the same amount as that for the test pattern T2. The standard dot distribution pattern for the test pattern T3 is rotated in step S7 in the same direction and by the same amount of rotation as that for the test pattern T2.

In step S8, measurement control unit 62 calculates the deviation in the position and discharge angle of each of nozzles 8. Hereafter, the method for calculating the deviation in the position and discharge angle of one of nozzles 8 is discussed.

Measurement control unit 62 determines the dots (first and second dots) printed by same nozzle 8 in test patterns T1 to T2. Then, the position deviation L of these two dots relative to standard dot positions 49 (i.e., the relative distance from the position of the dots to the standard dot positions) is calculated for each. Position deviation L is determined from sum of the squares of the differences $L^2$ in step S8. Once position deviation L is calculated, calculated L values are plotted on a graph against discharge distances d when the dots were printed. As FIG. 23 shows, the positional data are plotted with point 80.

Figure 23:
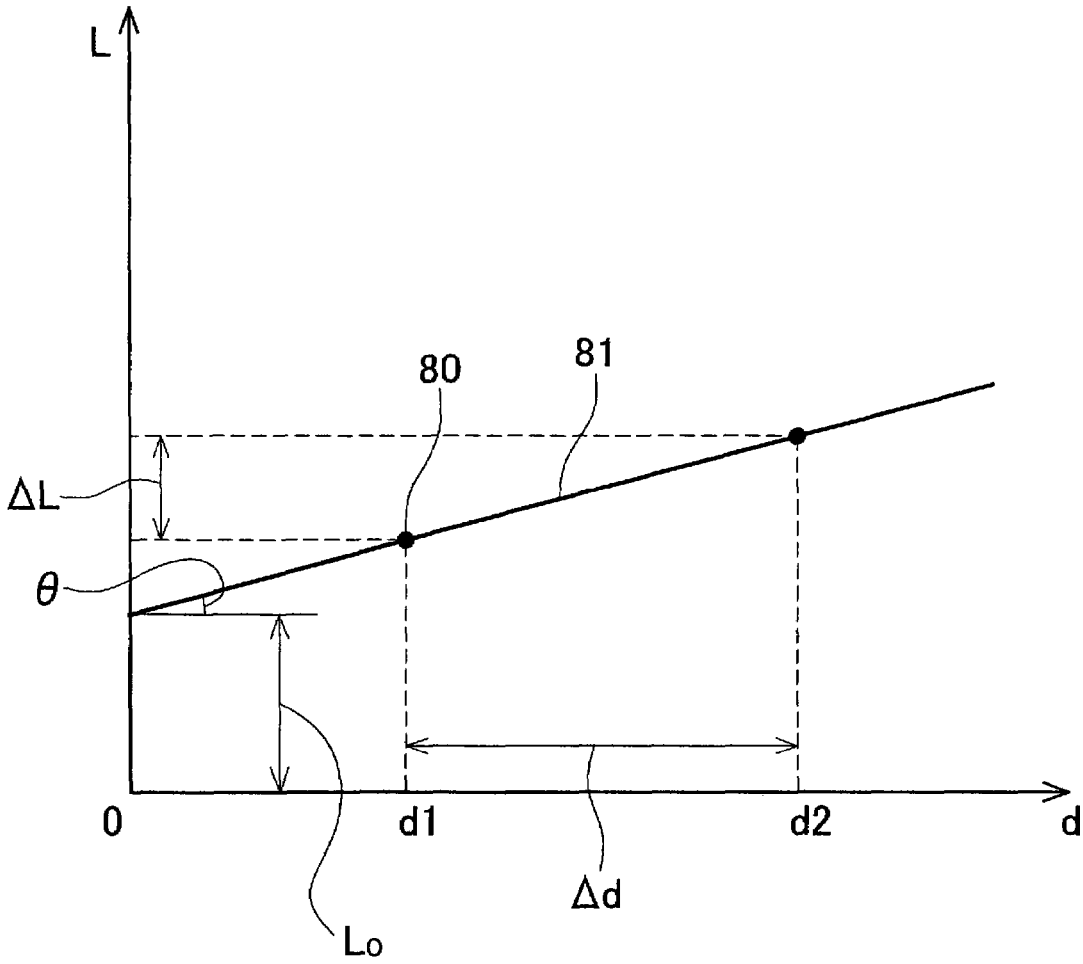
FIG. 23 illustrates a step of calculating nozzle position deviation and discharge angle deviation.
Figure 24:
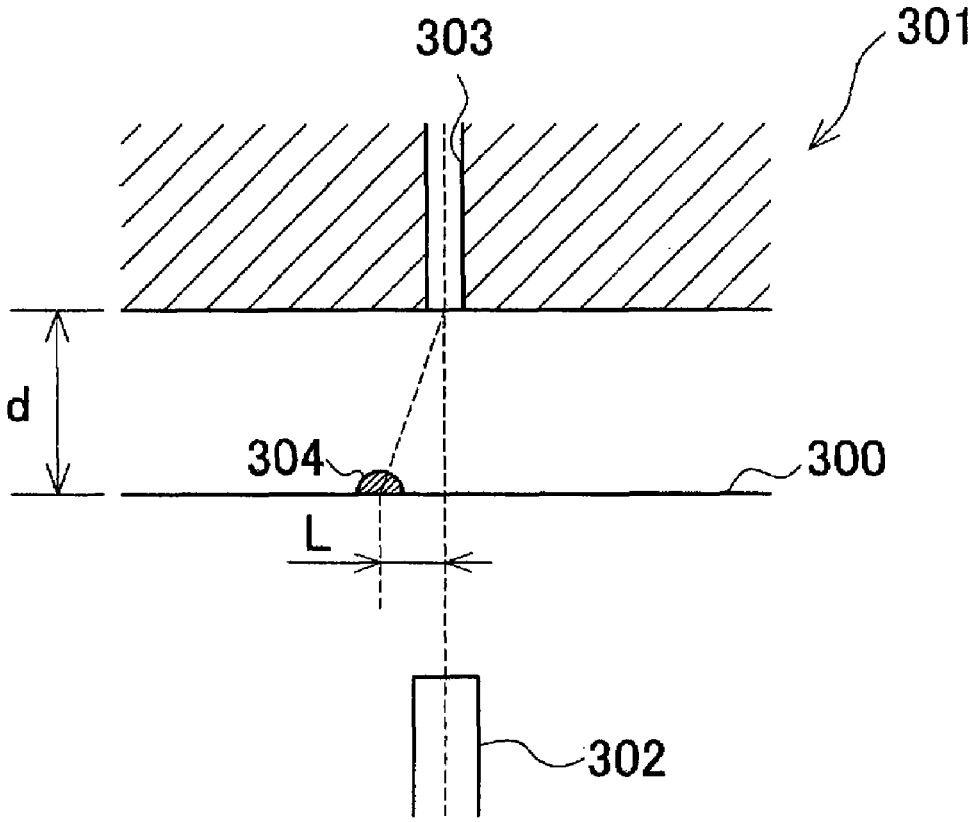
FIG. 24 shows a conventional inkjet head testing method.

Next, measurement control unit 62 calculates straight line 81 connecting each of points 80 as shown in FIG. 23. As was stated, the paths of ink discharged from nozzles 8 are approximately linear. The relationship between discharge distance d and position deviations L is therefore a linear one that can be expressed with straight line 81. The intersection of straight line 81 and the L axis is determined. The L axis is at the point where discharge distance d is zero. Deviation L of the ink adherence position when discharge distance d is zero corresponds to the position deviation of nozzle 8. In other words, L coordinate $L_0$ at the intersection of straight line 81 and the L axis represents nozzle 8 position deviation. Position deviation $L_0$ of nozzle 8 is calculated as such.

Measurement control unit 62 also calculates the discharge angle deviation from the slope of straight line 81. As stated earlier, the designed target discharge angle of nozzle 8 is directly downward (i.e., vertical). Therefore, the slope of straight line 81 represents the deviation in the discharge angle of nozzles 8. The slope of straight line 81 is calculated with the following formula based on difference Δd between discharge distances d1 and d2 and difference ΔL in the position deviations of the dots at these discharge distances.

$$\text{Deviation in discharge angle}=\arctan(\Delta L/\Delta d)$$

The position deviation and discharge angle deviation of nozzles 8 is calculated as such. Measurement control unit 62 performs calculations for all of dots 40 in this manner and calculates the position deviation and discharge angle deviation of all of nozzles 8 discharging ink. If the position deviation of one of nozzles 8 is found to be greater than or equal to a specified amount as a result of calculating the position deviation and discharge angle deviation of nozzles 8, that nozzle 8 will be assessed as having a nozzle position error. If the discharge angle deviation is greater than or equal to a specified amount, that nozzle 8 will be assessed as having a discharge angle error.

In step S9, the variance in discharge velocity of nozzles 8 is calculated by measurement control unit 62. Discharge velocity variance is calculated by comparing test pattern T2 to test pattern T3.

Figure 22:
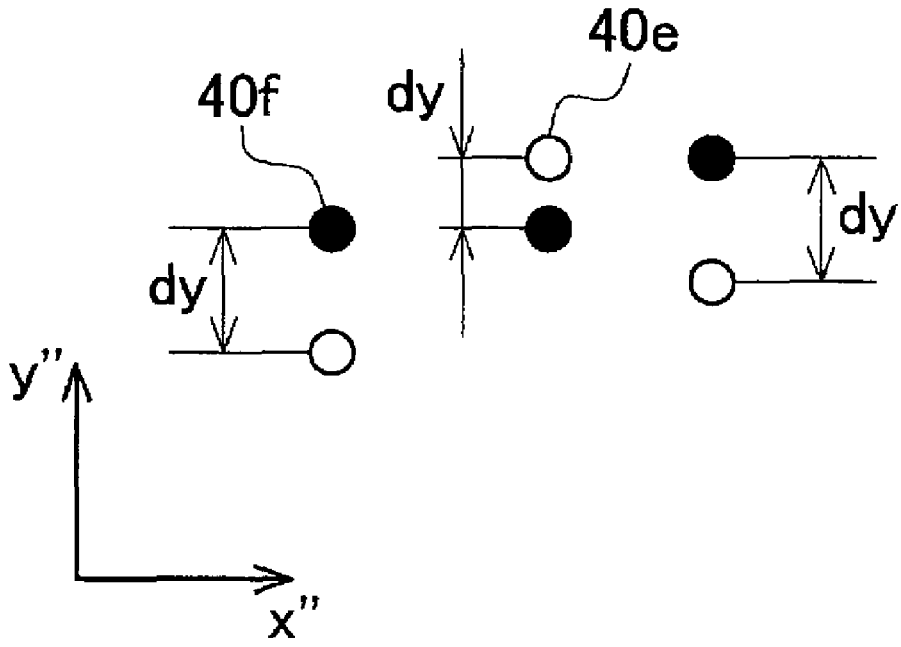
FIG. 22 illustrates a method for testing variance in ink discharge velocities.

FIG. 22 shows second dot 40*e* of test pattern T2 and third dot 40*f* of test pattern T3 in a superimposed manner so that the standard dot positions match. Test pattern T2 was printed when ink was discharged with printing paper 22 stopped, and test pattern T3 was printed when ink was discharged with printing paper 22 being fed. The other printing conditions of test pattern T2 and test pattern T3 are identical. As was stated earlier, deviations in ink adherence positions occur according to the discharge velocity of the ink when ink is discharged as printing paper 22 is being fed. So as shown in FIG. 22, the position of dot 40*f* deviates from that of dot 40*e* in the y" direction according to the discharge velocity. FIG. 22 also shows the deviation of each dot 40*e* in the y" direction as dy.

As was stated, the standard dot distribution pattern of test pattern T3 is set similarly to that for test pattern T2. Therefore, dot 40*e* initially set at the origin in test pattern T2 and dot 40*f* initially set at the origin in test pattern T3 share identical coordinates. Therefore, deviation dy of the discharge velocity of the ink forming the dot at the origin (hereinafter called the dot discharge velocity) and the dots printed at the same discharge velocity equals zero. Deviation dy of dots printed at a discharge velocity slower than the discharge velocity of the dot at the origin is positive. Conversely, deviation dy of dots printed at a discharge velocity faster than the discharge velocity of the dot at the origin is negative. In other words, deviation dy changes in accordance with the dot discharge velocity relative to the discharge velocity of the dot at the origin.

Measurement control unit 62 calculates the deviation dy of dots 40 from the positions of second dots 40*e* of test pattern T2 and the positions of third dots 40*f* of test pattern T3. Moreover, the variance in the discharge velocity of nozzles 8 is calculated from the variance in the deviation dy of dots 40. If the variance in the discharge velocities thus calculated is greater than or equal to a specified amount, the inkjet head 1 is assessed as failing.

According to the testing method of an inkjet head of the first embodiment discussed earlier, printing paper 22 is set at different distances from inkjet head 1 and test patterns T1 and T2 are printed on printing paper 22 in steps S2 and S3. The nozzle position deviation and discharge angle deviation are calculated based on the positions of the dots of test patterns T1 and T2 (first dots and second dots) and discharge distances d1 and d2 of steps S2 and S3. Nozzle position deviation and discharge angle deviation can therefore be calculated without the use of transparent printing paper. In other words, the printing paper on which the test pattern is to be printed can be freely selected. As in the first embodiment, the use of a printing paper, with a recording surface formed from an ink-absorbing layer having a swelling characteristic or porous surface, as the test sheet allows ink to be suitably absorbed by the printing paper, so the ink does not flow on the printing paper. Sharp dots can therefore be formed. If the surface roughness of the recording surface is 2.0 μm or less as in the first embodiment, even sharper dots can be formed. Nozzle position deviations and discharge angle deviations can therefore be detected with greater accuracy.

In the testing method of the first embodiment, a CCD camera need not be provided on the rear side of printing paper 22 as in conventional testing methods, so testing with simpler testing devices becomes possible.

In the testing method of the first embodiment, the straight line connecting the dots formed by same nozzle 8 in test patterns T1 and T2 (first dots and second dots) is calculated as was discussed in step S8, and nozzle position deviations and discharge angle deviations are detected based on the straight line thus calculated. Nozzle position deviations and discharge angle deviations can be detected with greater accuracy using this method.

As was discussed in steps S3, S4, and S9, the testing method of the first embodiment compares test pattern T2, which is printed with printing paper 22 stopped, with test pattern T3, which is printed with printing paper 22 moving. This enables the detection of variance in the discharge velocities of nozzles 8.

In the testing method of the first embodiment, the standard dot distribution pattern is set through parallel movement and rotation in steps S6 and S7 so that mean $ML^2$ of sum of the squares of the differences $L^2$ of dots 40 is minimized. Setting the standard dot distribution pattern in this manner allows the standard dot distribution pattern to be matched to the designed target position without setting absolute position standards.

The testing method of the first embodiment calculates the nozzle position deviation and discharge angle deviation as well as the discharge velocity variance, but all these parameters need not necessarily be calculated. With regard to the nozzle position deviation and discharge angle deviation, for example, position deviations L of the dots in the test patterns T1 and T2 from the standard dot positions could be compared, with nozzles 8 found to be abnormal if position deviations L of the first and second dots do not meet a specified value. And with regard to discharge velocity variance, deviation dy in the second and third dots could be calculated to check for errors based on the variance of deviation dy.

Figure 13:
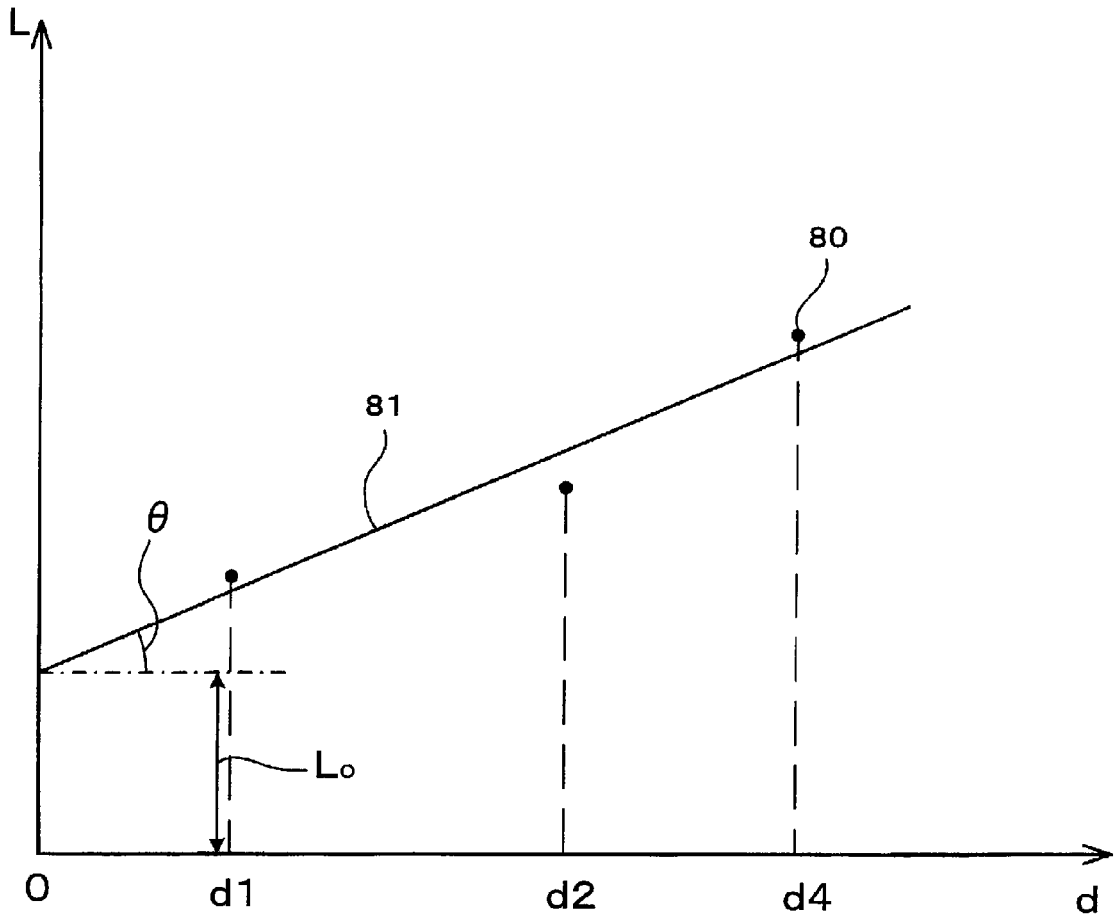
FIG. 13 illustrates a step of calculating nozzle position deviation and discharge angle deviation.

In the first embodiment discussed above, the position deviation and discharge angle deviation of nozzles 8 are calculated based on the straight line calculated from the positions of the first dots and the positions of the second dots, but the straight line could be calculated from the dots of test patterns T1, T2, and T4 (first dots, second dots, and fourth dots) following the printing of a test pattern with a different discharge distance (e.g., test pattern T4 printed at discharge distance d4). FIG. 13 illustrates a method for calculating position deviations and discharge angle deviations of nozzles 8 from three test patterns T1, T2, and T4. As FIG. 13 shows, position deviation L of each dot is plotted against discharge distance d as in step S8 discussed earlier. Then, straight line 81 approximately connecting points 80 is calculated, and position deviation $L_0$ and the discharge angle deviation of nozzles 8 are determined. The preparation of a greater number of test patterns in this manner allows the position deviation and discharge angle deviation of nozzles 8 to be calculated with greater accuracy.

In the first embodiment, discharge distance d was short and ink was discharged at a high speed, so the path of the ink approximated a straight line. But if the discharge distance d of the inkjet head to be tested were relatively long or the ink discharge speed were relatively slow, the ink path could be approximated to a parabola (secondary curve) in consideration of the gravity acting on the discharged ink. Therefore, the nozzle position deviation and discharge angle deviation of the nozzles can be calculated from the ink path even if the path is calculated with another method.

In the first embodiment, the parallel movement step and rotation step were executed only one time each, but these steps could be repeated. Repetition of the parallel movement step and rotation step would allow standard dot positions 49 to better match the designed target positions.

Figure 12:
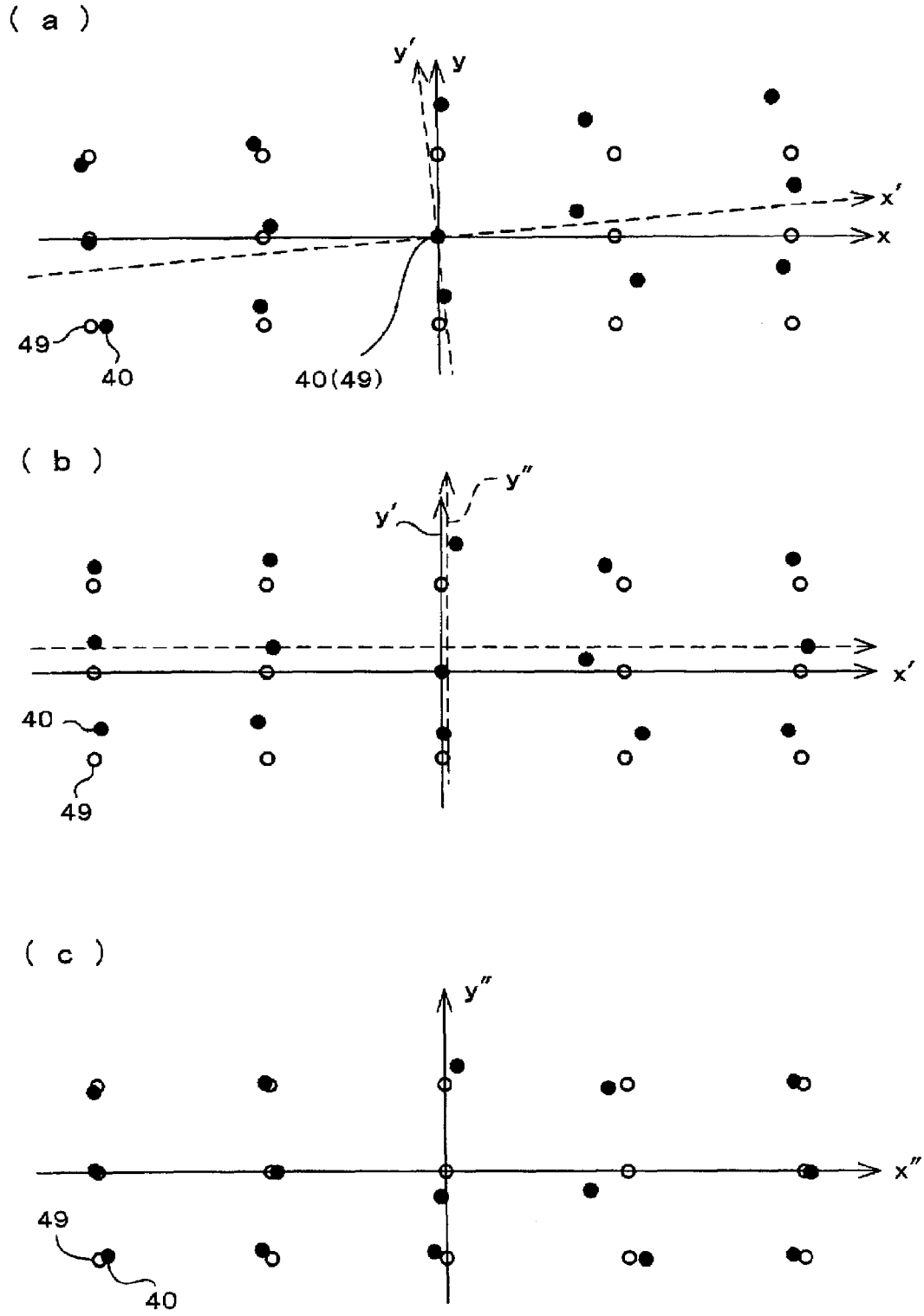
FIGS. 12(*a*), 12(*b*), and 12(*c*) illustrate the setting of the standard dot distribution pattern performed in the inkjet head testing method.

In the first embodiment, the standard dot distribution pattern was subjected to parallel movement and then rotation in steps S7 and S8, but rotation could be carried out before parallel movement. If the standard dot distribution pattern were subjected to parallel movement in this manner, standard dot positions 49 shown in FIG. 12(*a*) to FIG. 12(*c*) would be moved.

In steps S7 and S8 of the first embodiment, the standard dot distribution pattern is moved together with the x and y axes (i.e., the coordinates of each dot 40 undergoes coordinate conversion), but standard dot positions 49 could be similarly set with a method by which the standard dot distribution pattern is moved (i.e., standard dot positions 49 undergo coordinate conversion).

In step S6 of the first embodiment, the dot first measured is taken as the origin for the measurement of the positions of the dots, but alternatively, an appropriate position on the printing surface could be taken to be the origin followed by the measurement of the positions of the dots, the setting of the specified dot as the origin, and the coordinate conversion of the coordinates of each measured dot.

In the first embodiment, a testing method for a so-called piezo inkjet head that discharges ink by deforming a piezoelectric layer is discussed, but the testing method of the invention can be used for a droplet discharge device of the thermal variety, static electricity variety, or other construction.

In the first embodiment, a test pattern is printed with the printing paper stopped in steps S2 to S4, while a test pattern is printed with the printing paper moving in step S5. But a test pattern could be printed with the printing paper moving in steps S2 to S4 and printed with the printing paper stopped in step S5. Abnormalities in nozzle position deviation, discharge angle deviation, and discharge velocity variance could be detected even if the test pattern were printed in this manner.

The inkjet head 1 discussed earlier had a target discharge angle of straight downward, but the testing method of the invention could be also carried out for an inkjet head that discharges ink in another direction (e.g., diagonally).

Second Embodiment of the Invention

Figure 16:
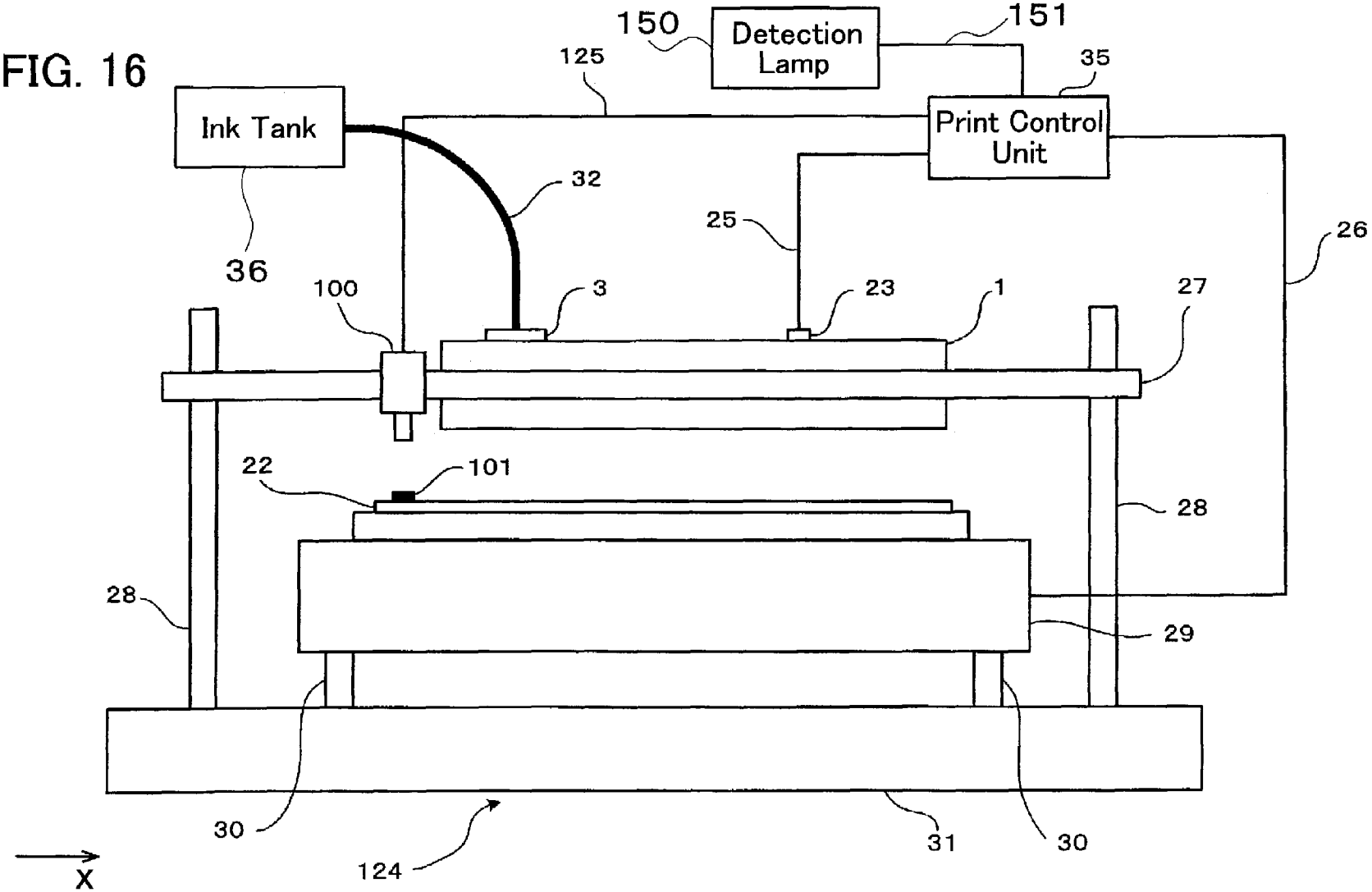
FIG. 16 is a front view of the test pattern printing device used in the second embodiment.
Figure 17:
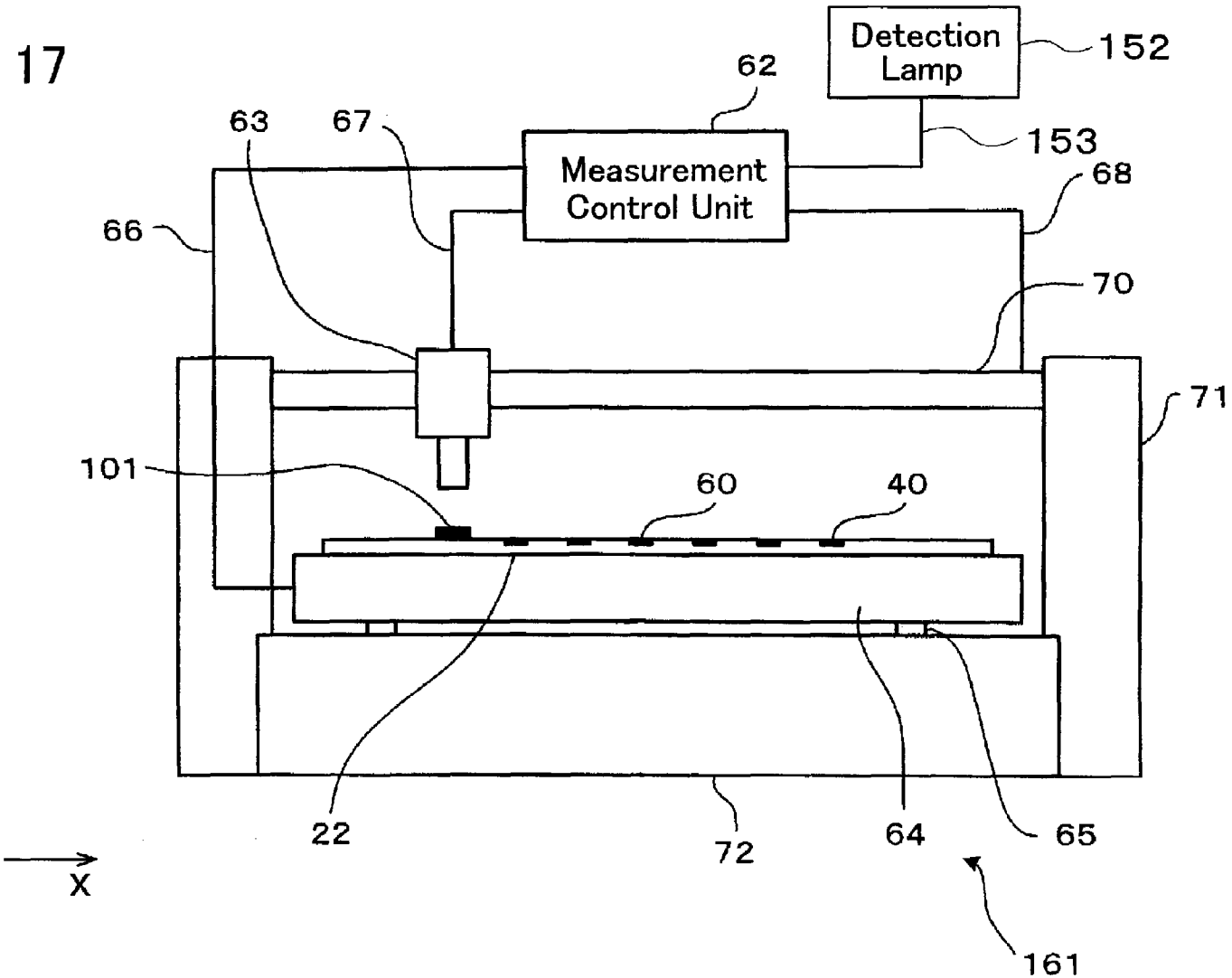
FIG. 17 is a front view of the test pattern measuring device used in the second and third embodiments.

A second embodiment of an inkjet head test method of the invention is discussed here. The second embodiment contains many steps and components common to the first embodiment, so descriptions thereof are omitted when appropriate. In the testing method of an inkjet head of the second embodiment, test pattern printing device 124 that is shown in FIG. 16 and test pattern measuring device 161 that is shown in FIG. 17 are used. In the testing method of the second embodiment, position errors and discharge angle errors of nozzles 8 are assessed.

The test pattern printing device 124 shown in FIG. 16 prints test patterns on printing paper 22 that is provided with marker 101 as shown in FIG. 16. Marker 101 is provided at a specified position on the recording surface of printing paper 22. Marker 101, which is a thin, rectangular sheet, is, as FIG. 16 shows, very small relative to printing paper 22.

The composition of test pattern printing device 124 of the second embodiment is similar to the composition of test pattern printing device 24 of the first embodiment. Test pattern printing device 124, however, comprises marker measurement unit 100 and detection lamp 150 absent in test pattern printing device 24.

Detection lamp 150 is connected to print control unit 35 by control cable 151. Detection lamp 150 becomes lit with the input of an electric signal from print control unit 35.

Marker measurement unit 100 is secured to a fixed position of head securing plate 27. Inkjet head 1 is also secured to head securing plate 27. Therefore, inkjet head 1 and marker measurement unit 100 are secured at a certain positional relationship. Marker measurement unit 100 is connected to print control unit 35 via control cable 125. Marker measurement unit 100 photographs images directly downward, or the recording surface of printing paper 22, and when marker 101 on the recording surface is photographed at a specified position, a detection signal is output to the print control unit 35. Following input of the detection signal from marker measurement unit 100, print control unit 35 lights detection lamp 150.

FIG. 17 shows test pattern measuring device 161 of the second embodiment. The composition of test pattern measuring device 161 of the second embodiment is similar to the composition of test pattern measuring device 61 of the first embodiment. Detection lamp 152 absent in test pattern measuring device 61, however, is present.

Detection lamp 152 is connected to measurement control unit 62 by control cable 153. Detection lamp 152 becomes lit with the input of an electric signal from measurement control unit 62.

Figure 18:
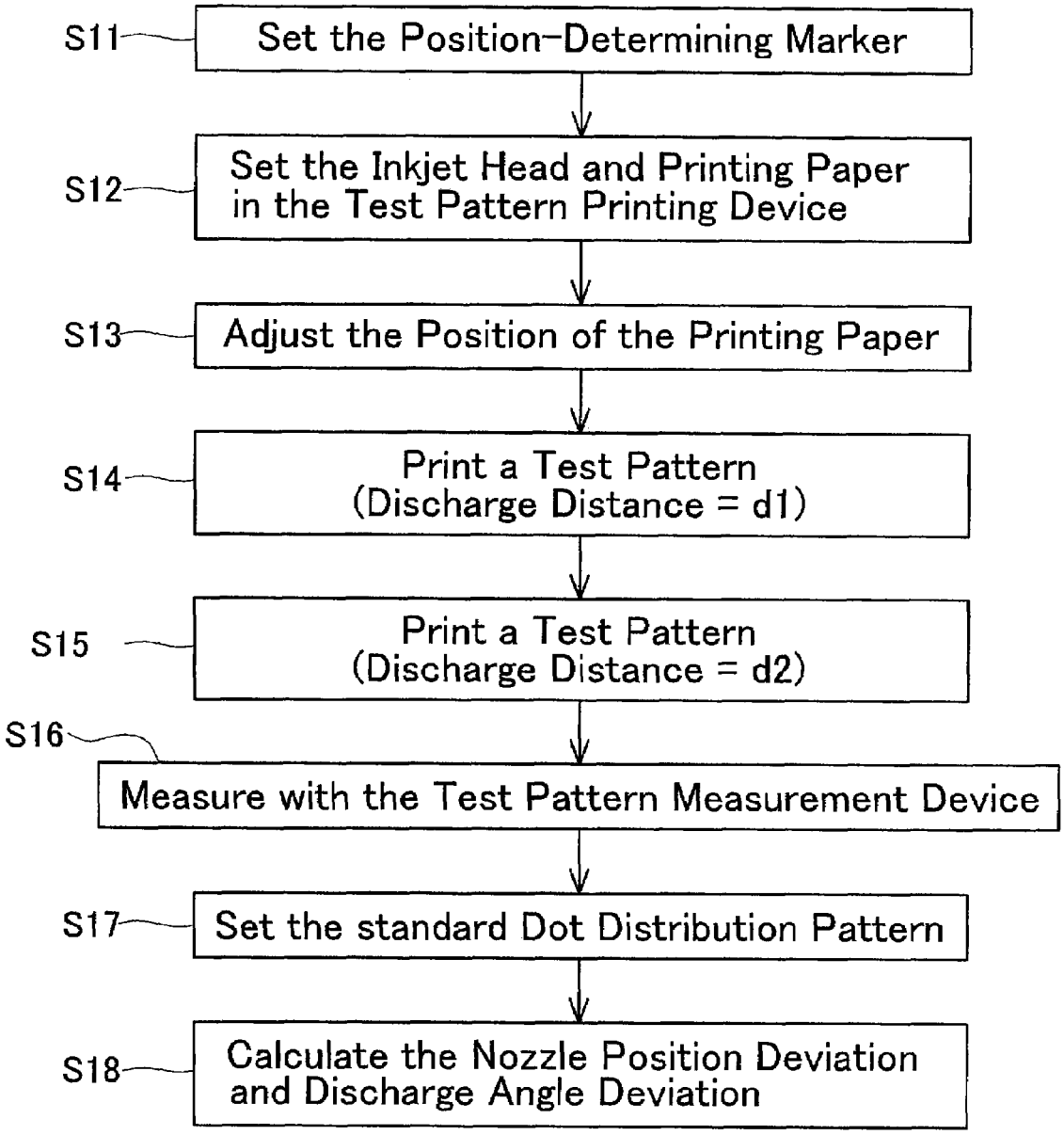
FIG. 18 is a flowchart showing the inkjet head testing process of the second embodiment.

Hereafter, the testing method of inkjet head 1 of the second embodiment is discussed in reference to FIG. 18.

First, marker 101 is provided at a specified position on the recording surface of printing paper 22 (S11).

Next, inkjet head 1 and printing paper 22 are set to test pattern printing device 124 (S12).

Then, test pattern printing device 124 is activated, and the position of printing paper 22 is adjusted (S13). In greater detail, the activation of test pattern printing device 124 initiates the detection of images on the recording surface of printing paper 22 by marker measurement unit 100. When marker measurement unit 100 has detected marker 101 in the measurement range, the shape of marker 101 is recognized. Detection lamp 150 becomes lit when marker 101 recognized by marker measurement unit 100 is at a specified position. If marker 101 is not at the specified position, detection lamp 150 does not light. In other words, the detection lamp does not light unless printing paper 22 is set at the specified position in test pattern printing device 124. The position of printing paper 22 is therefore adjusted until detection lamp 150 becomes lit (i.e., until printing paper 22 is at the specified position). This prevents printing paper 22 from becoming misaligned or tilted relative to test pattern printing device 124.

Once the position of printing paper 22 has been adjusted, a first test pattern (hereinafter referred to as test pattern T5) is printed with d1 as the discharge distance between nozzle surface 60 of inkjet head 1 and printing paper 22 (S14). Then, printing paper 22 is fed by the specified amount. Next, a second test pattern (hereinafter referred to as test pattern T6) is printed with d2 as the discharge distance (S15).

Next, printing paper 22 is set in test pattern measuring device 161. Then, test pattern measuring device 161 is activated. At this time, the position of marker 101 is detected by camera 63. If the detected position of marker 101 is the specified position, measurement control unit 35 lights detection lamp 152. If the detected position of marker 101 is greater than the specified position or marker 101 is tilted, detection lamp 152 does not light. If detection lamp 152 is not lit, the position of printing paper 22 will be adjusted until detection lamp 152 lights. This prevents printing paper 22 from becoming misaligned or tilted relative to test pattern measuring device 161. Once detection lamp 152 has lit, dot position measurement by test pattern measuring device 161 is commenced. At this time, the positions of the dots of test pattern T5 are measured with the position of marker 101 as the origin. Once the positions of all dots of test pattern T5 have been measured, camera 63 returns to the position of the origin. Printing paper 22 is moved by a distance identical to the distance printing paper 22 was moved at the conclusion of S14. At this time, the positions of the dots of test pattern T6 are measured with the position thereof as the origin (S16).

Once the positions of the dots have been measured, the standard dot distribution pattern is set (S17). Measurement control unit 62 of the second embodiment stores in memory the standard dot distribution pattern with the position of marker 101 (i.e., the position of marker measurement unit 100 of test pattern printing device 124) as the origin. Therefore, the standard dot distribution pattern is set with the position of marker 100 as the origin. Then, the position deviations and discharge angle deviations of nozzles 8 are calculated based on the standard dot positions of the standard dot distribution pattern and the positions of the dots of the test patterns T5 and T6 (S18).

In the testing method of the second embodiment as discussed above, printing paper 22 is set so that marker 100 takes on a specified position relative to test pattern printing device 124. Therefore, inkjet head 1 and marker 101 are placed into a specified positional relationship before a test pattern is printed. Printing paper 22 is set and the dot positions are measured with the position of marker 100 as the origin so that marker 100 takes on the specified positional relationship relative to test pattern measuring device 161. The standard dot distribution pattern is set with marker 100 as the origin. By making marker 100 an absolute position standard, the standard dot distribution pattern can be made to accurately match the designed target position without being moved (i.e., parallel movement, rotation).

In the testing method of the second embodiment, the position of the printing paper is adjusted so that the marker takes on the specified position when the position of marker 101 is found to be deviating as a result of the measurement of the position of marker 101 by test pattern measuring device 161. But if marker 101 deviates, the amount, direction, and angle of deviation could be measured for the movement (i.e., parallel movement, rotation) of the standard dot distribution pattern based on these values. Setting the standard dot distribution pattern in this manner as well allows the standard dot distribution pattern to be accurately matched with the designed target positions.

Marker 101 was provided on printing paper 22 in advance in the testing method of the second embodiment, but marker 101 could be printed concurrently with the printing of the test pattern on printing paper 22. The testing method of the third embodiment, in which marker 101 is printed concurrently with the printing of the test pattern, is discussed next. The third embodiment contains many steps and components common to the first and second embodiments, so descriptions thereof are omitted when appropriate.

Third Embodiment of the Invention

Figure 19:
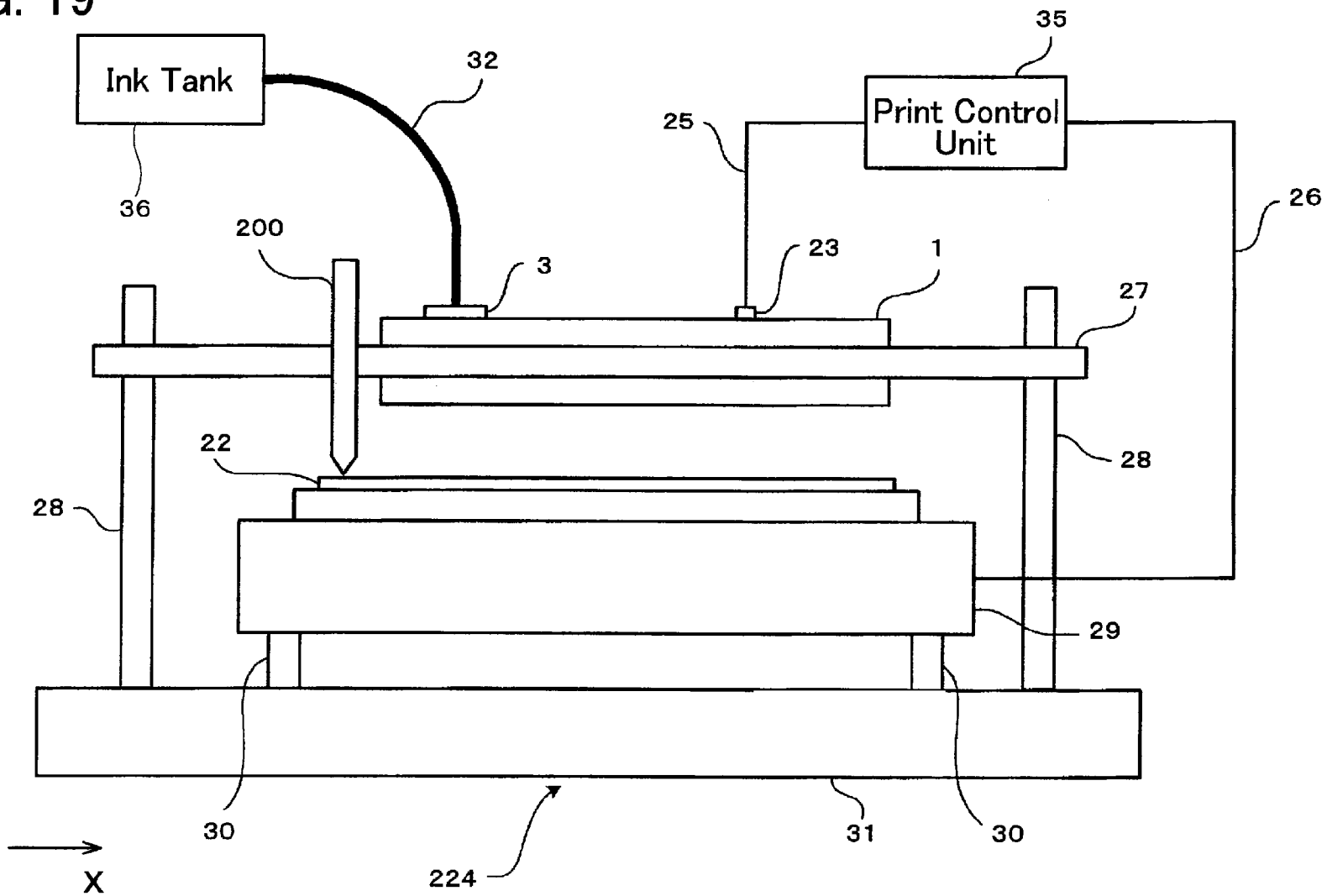
FIG. 19 is a front view of the test pattern printing device used in the third embodiment.

FIG. 19 shows test pattern printing device 224 of the third embodiment of the invention. The composition of test pattern printing device 224 of the third embodiment is similar to the composition of test pattern printing device 24 of the first embodiment. Test pattern printing device 224, however, comprises marker attaching unit 200 absent in test pattern printing device 24.

Marker affixing unit 200 is vertically movable relative to a fixed position of head securing plate 27. Inkjet head 1 is also secured to head securing plate 27. Therefore, inkjet head 1 and marker affixing unit 200 are secured at a certain positional relationship in the x and y directions. Marker affixing unit 200 is impelled upward by a spring and stops with a gap between the tip thereof and printing platform 29. Marker affixing unit 200 is manually or otherwise pressed downward to move the marker affixing unit 200 in the downward direction. An ink discharge port is formed on the lower end of the marker affixing unit 200. When the upper surface of marker affixing unit 200 is pressed with the hand to press the lower end of marker affixing unit 200 against printing paper 22 on printing platform 29, ink adheres to printing paper 22. At this time, a rectangular figure is printed on printing paper 22.

Figure 20:
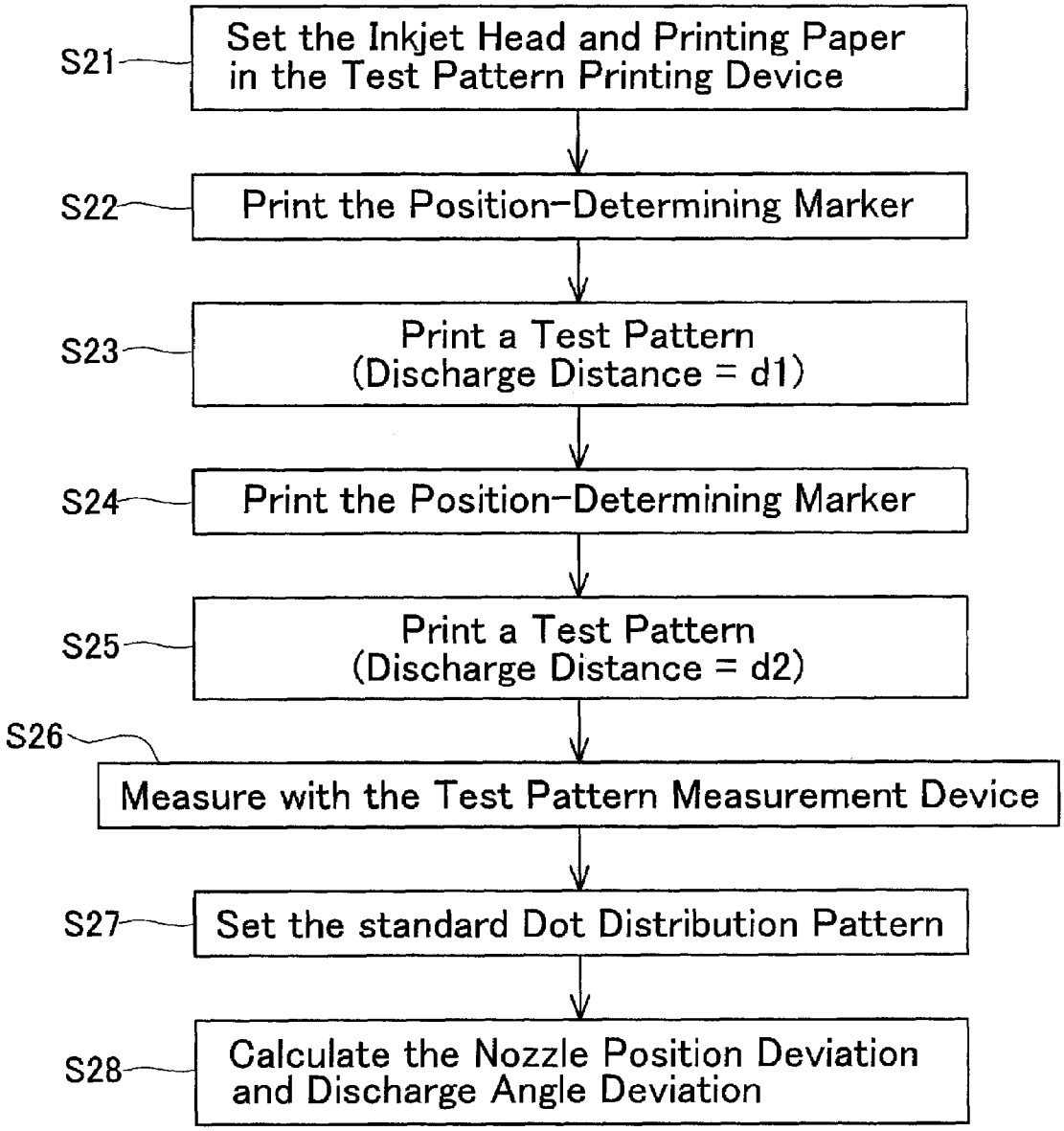
FIG. 20 is a flowchart showing the inkjet head testing process of the third embodiment.

Hereafter, the testing method of the inkjet head 1 of the third embodiment is discussed in reference to FIG. 20.

In test pattern printing in the third embodiment, inkjet head 1 and printing paper 22 are set to test pattern printing device 224 (S21). Then, marker affixing unit 200 is pressed with the hand to adhere ink to printing paper 22 (S22). The adhered ink becomes a standard for determining positions, or the marker 101 (hereinafter referred to as first marker 101) on printing paper 22. Next, a test pattern (hereinafter referred to as test pattern T7) is printed with d1 as the discharge distance (S23). When test pattern T7 has been printed, printing paper 22 is fed the designated amount. Once printing paper 22 has been fed, printing paper 22 is stopped. Then, marker 101 is printed on printing paper 22 by marker affixing unit 200 (hereinafter referred to as the second marker 101) (S24). Next, a test pattern (hereinafter referred to as test pattern T8) is printed with d2 as the discharge distance (S25).

Next, printing paper 22 is set in test pattern measuring device 161 as in step S16 of the second embodiment. Then, the test pattern measuring device 161 is activated. At this time, test pattern measuring device 161 measures the positions of the dots of test pattern T7 with first marker 101 as the origin. When the measurement of the dots of test pattern T7 has concluded, test pattern measuring device 161 measures the positions of the dots of test pattern T8 with second marker 101 as the origin (step S26). Test pattern measuring device 161, after measuring the positions of all dots, sets the standard dot distribution pattern relative to the origin (step S27) and then calculates the position deviations and discharge angle deviations of nozzles 8 and checks for errors therein (step S28).

As previously discussed, the testing method of the third embodiment prints markers 101 concurrently with the printing of the test patterns. Therefore, position adjustment becomes unnecessary when printing paper 22 is set to test pattern printing device 224. Furthermore, marker measurement unit 100 of the second embodiment is not needed, allowing for test pattern printing device 224 to be given a simpler construction.

What is claimed is:

1. A method of testing a droplet discharge device, comprising:

a first step of setting a test sheet at a first distance from the droplet discharge device;

a second step of discharging at least one droplet toward the test sheet set in the first step from a nozzle formed in the droplet discharge device to form at least one first dot on the test sheet;

a third step of setting a test sheet at a second distance from the droplet discharge device, the second distance being different from the first distance;

a fourth step of discharging at least one droplet toward the test sheet set in the third step from the nozzle to form at least one second dot on the test sheet; and a fifth step of calculating at least either position error of the nozzle or discharge angle error of the nozzle from the position of the first dot, the position of the second dot, the first distance and the second distance.

2. A method of claim 1, wherein at least one droplet is discharged from a plurality of nozzles respectively to form a first dot distribution pattern in the second step, and at least one droplet is discharged from the plurality of nozzles respectively to form a second dot distribution pattern in the fourth step.

3. A method of claim 2, wherein at least one droplet is discharged from each of the plurality of nozzles in the second and fourth steps, the nozzles being aligned in a row.

4. A method of claim 2, wherein the fifth step comprises:

preparing a standard dot distribution pattern corresponding to a standard position of nozzles and standard droplet discharge angle;

matching the first dot distribution pattern and the standard dot distribution pattern and identifying a first positional relation of the standard dot distribution pattern with respect to the first dot distribution pattern;

matching the second dot distribution pattern and the standard dot distribution pattern and identifying a second positional relation of the standard dot distribution pattern with respect to the second dot distribution pattern; and calculating position error of the nozzles from the first positional relation, the second positional relation, the first distance, and the second distance.

5. A method of claim 4, wherein the step of matching the first dot distribution pattern and the standard dot distribution pattern comprises calculating a distance between a dot in the standard dot distribution pattern and a corresponding dot in the first dot distribution pattern, and the step of matching the second dot distribution pattern and the standard dot distribution pattern comprises calculating a distance between a dot in the standard dot distribution pattern and a corresponding dot in the second dot distribution pattern.

6. A method of claim 5, wherein the step of matching the first dot distribution pattern and the standard dot distribution pattern comprises shifting the standard dot distribution pattern with respect to the first dot distribution pattern without changing an angle between the two patterns (parallel shifting), and the step of matching the second dot distribution pattern and the standard dot distribution pattern comprises shifting the standard dot distribution pattern with respect to the second dot distribution pattern without changing an angle between the two patterns (parallel shifting).

7. A method of claim 5, wherein the step of matching the first dot distribution pattern and the standard dot distribution pattern comprises rotating the standard dot distribution pattern with respect to the first dot distribution pattern, and the step of matching the second dot distribution pattern and the standard dot distribution pattern comprises rotating the standard dot distribution pattern with respect to the second dot distribution pattern.

8. A method of claim 2, wherein the fifth step comprises:

preparing a standard dot distribution pattern corresponding to a standard position of nozzles and standard droplet discharge angle;

matching the first dot distribution pattern and the standard dot distribution pattern and identifying a first positional relation of the standard dot distribution pattern with respect to the first dot distribution pattern that gives the highest matching degree;

matching the second dot distribution pattern and the standard dot distribution pattern and identifying a second positional relation of the standard dot distribution pattern with respect to the second dot distribution pattern that gives the highest matching degree; and calculating discharge angle error from the first positional relation, the second positional relation, the first distance and the second distance.

9. A method of claim 8, wherein the step of matching the first dot distribution pattern and the standard dot distribution pattern comprises calculating a distance between a dot in the standard dot distribution pattern and a corresponding dot in the first dot distribution pattern, and the step of matching the second dot distribution pattern and the standard dot distribution pattern comprises calculating a distance between a dot in the standard dot distribution pattern and a corresponding dot in the second dot distribution pattern.

10. A method of claim 9, wherein the step of matching the first dot distribution pattern and the standard dot distribution pattern comprises shifting the standard dot distribution pattern with respect to the first dot distribution pattern without changing an angle between the two patterns (parallel shifting), and the step of matching the second dot distribution pattern and the standard dot distribution pattern comprises shifting the standard dot distribution pattern with respect to the second dot distribution pattern without changing an angle between the two patterns (parallel shifting).

11. A method of claim 9, wherein the step of matching the first dot distribution pattern and the standard dot distribution pattern comprises rotating the standard dot distribution pattern with respect to the first dot distribution pattern, and the step of matching the second dot distribution pattern and the standard dot distribution pattern comprises rotating the standard dot distribution pattern with respect to the second dot distribution pattern.

12. A method of claim 1, wherein in the first step, the test sheet having a mark is set such that the mark is located at a predetermined position with respect to the droplet discharge device;

wherein in the third step, the test sheet having a mark is set such that the mark is located at a predetermined position with respect to the droplet discharge device; and wherein in the fifth step, the position error of the nozzle is calculated from the position of the first dot, the position of the second dot, the first distance, the second distance and the position of the mark.

13. A method of claim 1, wherein in the first step, the test sheet having a mark is set such that the mark is located at a predetermined position with respect to the droplet discharge device;

wherein in the third step, the test sheet having a mark is set such that the mark is located at a predetermined position with respect to the droplet discharge device; and wherein in the fifth step, the discharge angle error of the nozzle is calculated from the position of the first dot, the position of the second dot, the first distance, the second distance and the position of the mark.

14. A method of claim 1, wherein the second step comprises forming a mark on the test sheet such that the mark is located at a predetermined position with respect to the droplet discharge device;

wherein the fourth step comprises forming a mark on the test sheet such that the mark is located at a predetermined position with respect to the droplet discharge device; and wherein in the fifth step, the position error of the nozzle is calculated from the position of the first dot, the position of the second dot, the first distance, the second distance and the position of the mark.

15. A method of claim 1, wherein the second step comprises forming a mark on the test sheet such that the mark is located at a predetermined position with respect to the droplet discharge device;

wherein the fourth step comprises forming a mark on the test sheet such that the mark is located at a predetermined position with respect to the droplet discharge device; and wherein in the fifth step, the discharge angle error of the nozzle is calculated from the position of the first dot, the position of the second dot, the first distance, the second distance and the position of the mark.

16. A method of claim 1, wherein the position error of the nozzle or the discharge angle error of the nozzle is calculated from a straight line connecting the first dot and the second dot.

17. A method of claim 1, further comprising:

a sixth step of setting a test sheet at a third distance from the droplet discharge device, the third distance being different from the first distance and the second distance; and a seventh step of discharging at least one droplet toward the test sheet set in the sixth step from the nozzle to form at least one third dot on the test sheet;

wherein the position error of the nozzle or the discharge angle error of the nozzle is calculated from a straight line approximately connecting the first dot, the second dot and the third dot.

18. A method of claim 2, further comprising:

a sixth step of setting a test sheet at the second distance from the droplet discharge device;

a seventh step of discharging at least one droplet toward the test sheet set in the sixth step from the plurality of nozzles respectively to form a third dot distribution pattern on the test sheet, wherein the test sheet is moved within a sheet plane in at least either the fourth or seventh step and the moving speeds differ in the fourth step and the seventh step; and an eighth step of comparing the second dot distribution pattern and the third dot distribution pattern and determining the discharge velocity variance of the plurality of nozzles.

19. A method of claim 1, wherein the test sheet is covered with a liquid absorbing layer having a swelling characteristic or porous surface.

20. A method of claim 19, wherein the roughness of a recording surface of the test sheet is not more than 2.0 μm.

* * * * *